US010675886B2

(12) United States Patent
Nakagawa et al.

(10) Patent No.: US 10,675,886 B2
(45) Date of Patent: Jun. 9, 2020

(54) PRINTING APPARATUS, PRINTING METHOD, AND STORAGE MEDIUM

(71) Applicant: CANON KABUSHIKI KAISHA, Tokyo (JP)

(72) Inventors: Junichi Nakagawa, Tokyo (JP); Yumi Yanai, Yokohama (JP); Seiji Abe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/232,806

(22) Filed: Dec. 26, 2018

(65) Prior Publication Data

US 2019/0202210 A1 Jul. 4, 2019

(30) Foreign Application Priority Data

Dec. 28, 2017 (JP) ..... 2017-254136

(51) Int. Cl.

| | |
|---|---|
| ***B41J 2/195*** | (2006.01) |
| ***B41J 2/175*** | (2006.01) |
| ***B41J 2/18*** | (2006.01) |
| ***B41J 2/19*** | (2006.01) |

(52) U.S. Cl.

CPC ..... *B41J 2/195* (2013.01); *B41J 2/17566* (2013.01); *B41J 2/18* (2013.01); *B41J 2/19* (2013.01); *B41J 2002/17589* (2013.01)

(58) Field of Classification Search

CPC ..... B41J 2/2132; B41J 2/18; B41J 2/17566; B41J 29/393; B41J 2202/12; B41J 2/195; B41J 29/38; B41J 2002/17589; B41J 2/19

See application file for complete search history.

(56) References Cited

U.S. PATENT DOCUMENTS

| | | | |
|---|---|---|---|
| 9,211,721 | B2 | 12/2015 | Govyadinov et al. |
| 9,457,584 | B2 | 10/2016 | Govyadinov et al. |
| 9,623,659 | B2 | 4/2017 | Govyadinov et al. |
| 9,969,177 | B2 | 5/2018 | Govyadinov et al. |
| 2017/0197407 | A1* | 7/2017 | Karita ..... B41J 2/1404 |
| 2018/0201024 | A1 | 7/2018 | Govyadinov et al. |

FOREIGN PATENT DOCUMENTS

| | | | |
|---|---|---|---|
| JP | 2014-531349 | A | 11/2014 |

OTHER PUBLICATIONS

Copending, unpublished U.S. Appl. No. 16/232,790, filed Dec. 26, 2018, to Junichi Nakagawa et al.

* cited by examiner

*Primary Examiner* — Jannelle M Lebron
(74) *Attorney, Agent, or Firm* — Venable LLP

(57) ABSTRACT

A printing apparatus includes a circulation pathway that circulates an ink between a pressure chamber of a printing head and the outside thereof. The number of eject of the ink to be ejected from an ejection port of the printing head to a unit printing area is set according to a concentration of the ink in the circulation pathway.

12 Claims, 16 Drawing Sheets

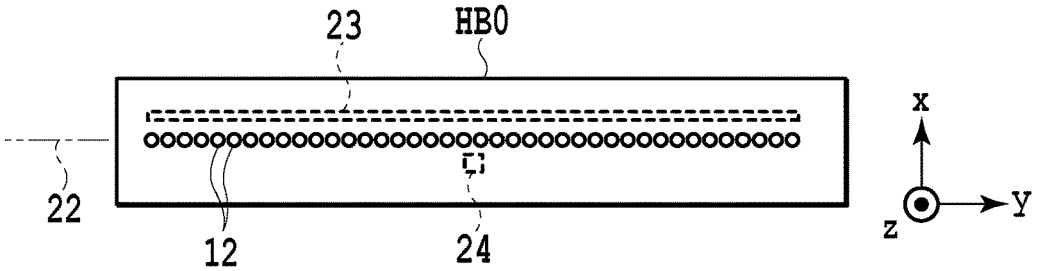
FIG.3A
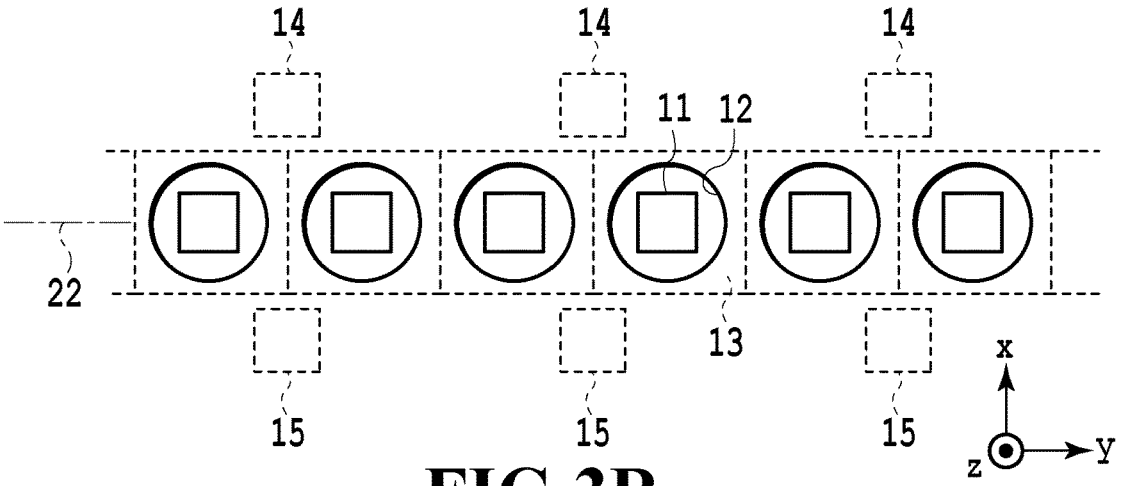
FIG.3B
FIG.3C
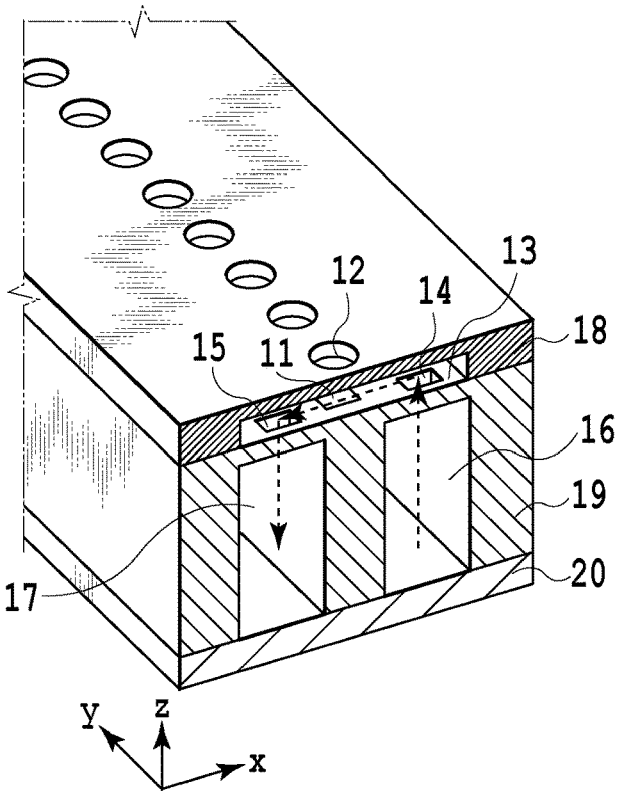

PRINTING APPARATUS, PRINTING METHOD, AND STORAGE MEDIUM

BACKGROUND OF THE INVENTION

Field of the Invention

The present invention relates to a printing apparatus, a printing method, and a storage medium for circulating an ink in a printing head.

Description of the Related Art

Japanese Patent Laid-Open No. 2014-531349 describes a configuration to circulate an ink in the vicinity of an ejection port of a printing head in order to reduce an influence of a viscous ink (a thickened ink) that is likely to develop in the vicinity of the ejection port.

SUMMARY OF THE INVENTION

An increase in concentration of the ink in the vicinity of the ejection port of the printing head can be suppressed by circulating the ink in the vicinity of the ejection port. However, thickening of the ink circulated in a circulation pathway gradually progresses with time, which increases an ink concentration to be ejected from the ejection port. Eventually, a printing density of an image becomes higher. In addition, when the ink is a pigment ink, the ink becomes more viscous along with the increase in ink concentration due to evaporation of moisture in the ink. When the above-described pigment ink with the higher viscosity is ejected onto a printing medium such as paper, the pigment contained in the ink is more likely to stay on a surface of the printing medium. As a consequence, if the pigment ink after the increase in viscosity is ejected onto the printing medium in the same manner as in the case before the increase in viscosity, the image printed on the printing medium is prone to deterioration in rub fastness that may get the inside of the printing apparatus dirty.

The present invention provides a printing apparatus, a printing method, and a storage medium, which are capable of printing a high quality image while suppressing an influence of a progress in ink thickening inside a circulation pathway.

In the first aspect of the present invention, there is provided a printing apparatus comprising:

a printing head configured to eject an ink in a pressure chamber from an ejection port;

a movement unit configured to conduct relative movement between the printing head and a printing medium;

a circulation pathway configured to circulate the ink between the pressure chamber and outside;

a concentration acquisition unit configured to acquire concentration information concerning a concentration of the ink in the circulation pathway;

a setting unit configured to set the number of eject of the ink to be ejected from the ejection port to a unit printing area such that the number of eject of the ink having a first concentration indicated by the concentration information is set less than the number of eject of the ink having a second concentration indicated by the concentration information lower than the first concentration; and a control unit configured to control the printing head in such a way as to eject the ink, from the ejection port, whose number of eject is set by the setting unit.

In the second aspect of the present invention, there is provided a printing method of printing on a printing medium while conducting relative movement between the printing medium and a printing head configured to eject an ink in a pressure chamber from an ejection port, the printing method comprising:

a circulating step of circulating the ink through a circulation pathway provided between the pressure chamber and outside;

a concentration acquiring step of acquiring concentration information concerning a concentration of the ink in the circulation pathway;

a setting step of setting the number of eject of the ink to be ejected from the ejection port to a unit printing area such that the number of eject of the ink having a first concentration indicated by the concentration information is set less than the number of eject of the ink having a second concentration indicated by the concentration information lower than the first concentration; and a controlling step of controlling the printing head in such a way as to eject the ink, from the ejection port, whose number of eject is set in the setting step.

In the third aspect of the present invention, there is provided a non-transitory computer readable storage medium storing a program to be executed by a computer to implement a printing method of printing on a printing medium while conducting relative movement between the printing medium and a printing head configured to eject an ink in a pressure chamber from an ejection port, wherein the printing method includes:

a circulating step of circulating the ink through a circulation pathway provided between the pressure chamber and outside;

a concentration acquiring step of acquiring concentration information concerning a concentration of the ink in the circulation pathway;

a setting step of setting the number of eject of the ink to be ejected from the ejection port to a unit printing area such that the number of eject of the ink having a first concentration indicated by the concentration information is set less than the number of eject of the ink having a second concentration indicated by the concentration information lower than the first concentration; and a controlling step of controlling the printing head in such a way as to eject the ink, from the ejection port, whose number of eject is set in the setting step.

According to the present invention, the number of eject of an ink to be ejected to a unit printing area is set according to a concentration of the ink in a circulation pathway. Thus, it is possible to print a high quality image and to maintain rub fastness of an image printed on a printing medium irrespective of a progress in ink thickening.

Further features of the present invention will become apparent from the following description of exemplary embodiments with reference to the attached drawings.

BRIEF DESCRIPTION OF THE DRAWINGS

FIGS. 3A, 3B, and 3C are explanatory diagrams of a heater board in FIG. 2;

DESCRIPTION OF THE EMBODIMENTS

Embodiments of the present invention will be described below with reference to the drawings.

First Embodiment

Figure 1:
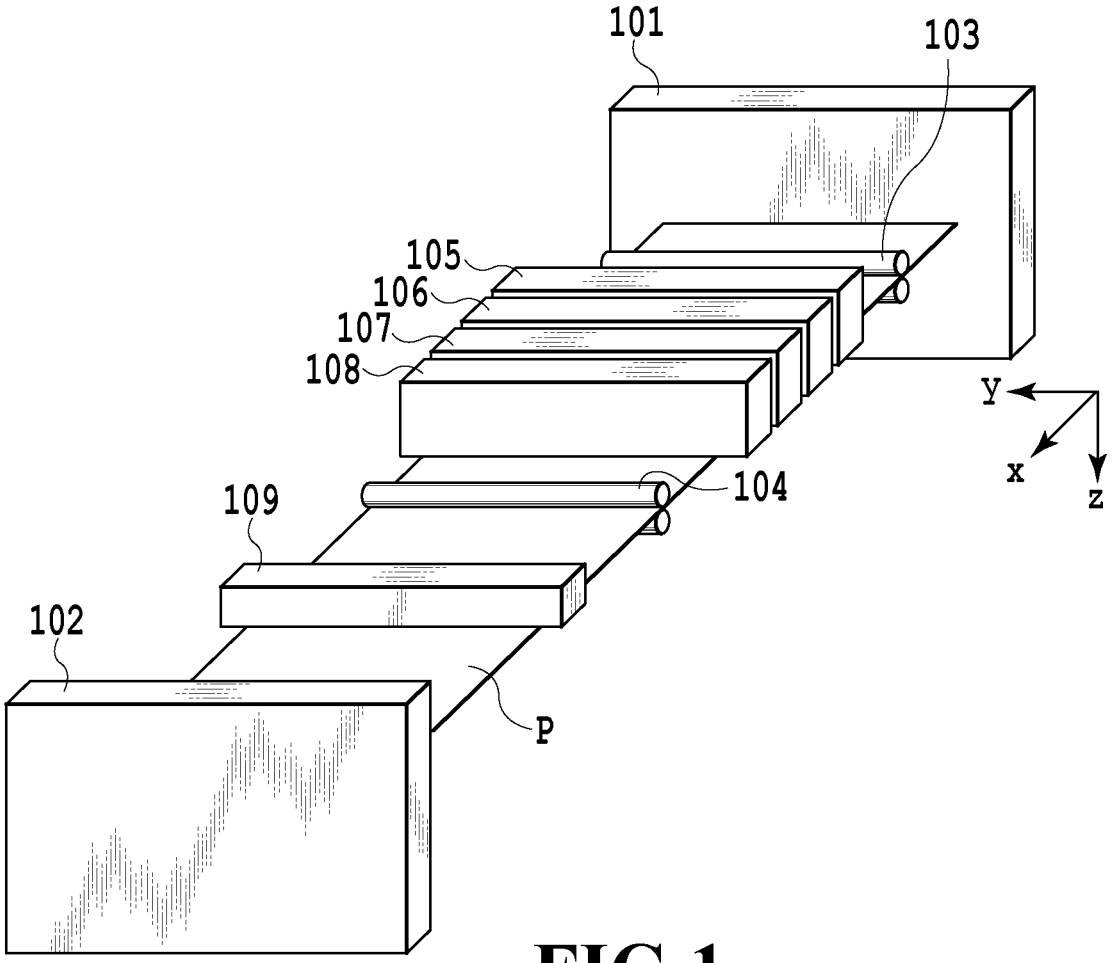
FIG. 1 is a schematic perspective view of a printing apparatus according to a first embodiment of the present invention.

FIG. 1 is an explanatory diagram of an internal structure of an inkjet printing apparatus (hereinafter also referred to as a "printing apparatus") of this embodiment. The printing apparatus of this embodiment represents an example of application to a printing apparatus of so-called a full line type.

A printing medium P to be fed from a feeder unit 101 is transported in the +x direction (a transport direction) while being sandwiched between paired transport rollers 103 and 104. After images are printed on the printing medium P by using printing heads 105, 106, 107, and 108, the printing medium P is ejected to an eject unit 102. The printing heads 105 to 108 are arranged in the transport direction between the paired transport rollers 103 on an upstream side in the transport direction and the paired transport rollers 104 on a downstream side in the transport direction, and are configured to eject inks in the +z direction in accordance with printing data as described later. The printing heads 105, 106, 107, and 108 eject cyan, magenta, yellow, and black inks, respectively.

The printing medium P may be a continuous sheet that is rolled and held by the feeder unit 101, or a cutout sheet that is cut out in a standard size in advance. When the printing medium P is the continuous sheet, the printing medium P is cut out into given lengths with a cutter 109 after termination of the printing operation with the printing heads 105 to 108, and then the cutout pieces are sorted by size and put onto eject trays of the eject unit 102.

(Printing Heads)

Figure 2:
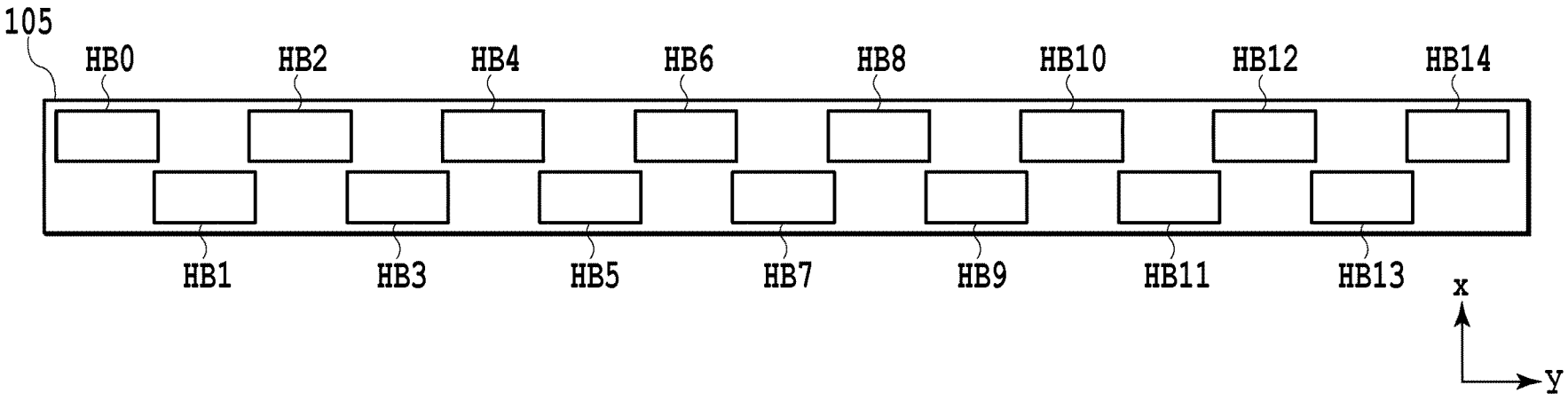
FIG. 2 is a schematic plan view of a printing head in FIG. 1.

FIG. 2 is an explanatory diagram of the printing head 105 for the cyan ink in this embodiment. Since the printing heads 105 to 108 have the same structure, the structure of the printing head 105 will be representatively explained below.

As shown in FIG. 2, the printing head 105 of this embodiment is provided with fifteen heater boards (printing element boards) HB0 to HB14. The heater boards that are adjacent to one another in the y direction are deployed such that end portions in the y directions of the heater boards overlap one another. The use of the printing head, in which the fifteen heater boards HB0 to HB14 are arranged in the y direction as described above, makes it possible to perform printing in the entire area of the printing medium having a long width in the y direction as with an elongated printing head formed from a single heat board.

FIGS. 3A, 3B, and 3C are explanatory diagrams of the heater board HB0. Since the heater boards HB0 to HB14 have the same structure, the structure of the heater board HB0 will be representatively explained. FIG. 3A is a schematic plan view of the heater board HB0, FIG. 3B is a partially enlarged plan view of the heater board HB0, and FIG. 3C is a cross-sectional view of the heater board HB0.

As shown in FIG. 3A, the heater board HB0 is provided with an ejection port row 22, a sub heater (a heating element) 23, and a temperature sensor (a detection element) 24. In the ejection port row 22, multiple ejection ports 12 for ejecting the cyan ink are arranged in the y direction. Pressure chambers 13 that communicate with the ejection ports 12 are provided with ejection energy generation elements which generate energy for ejecting the ink. A thermoelectric conversion element (a heater), a piezoelectric element, and the like can be used as each ejection energy generation element (a printing element). In the case of this embodiment, ink eject heaters 11 are provided as the ejection energy generation elements at positions opposed to the ejection ports 12. A bubble is formed in the ink inside each pressure chamber 13 by generating thermal energy while applying a drive pulse to each heater 11, and the ink can be ejected from the corresponding ejection port 12 by use of the bubble energy. A row of the ejection energy generation elements (the printing elements) corresponding to the ejection ports 12 constituting the ejection port row 22 is also referred to as a printing element row.

The sub heater 23 is a heater for heating the ink in the vicinity of the printing elements in the heater board HB0 to the extent that the ink is kept from being ejected from the ejection ports 12. The temperature sensor 24 is a sensor for detecting a temperature in the vicinity of the printing elements in the heater board HB0. As described later, the ink inside the heater board HB0 is controlled at a desired temperature by driving the sub heater 23 based on the temperature detected with the temperature sensor 24. In this embodiment, the heater board HB0 is provided with the single sub heater 23 and the single temperature sensor 24. Instead, the heater board HB0 may be provided with two or more sub heaters 23 and two or more temperature sensors 24.

As shown in FIG. 3B, each ink eject heater 11 is provided inside the pressure chamber 13 compartmented by partition walls. Meanwhile, supply ports 14 for the ink are provided at positions on the +x direction side of the ejection port row 22 and recovery ports 15 for the ink are provided at positions on the −x direction side thereof. In the case of this embodiment, one supply port 14 and one recovery port 15 are provided for every two ejection ports 12.

The heater board HB0 is formed from three layers as shown in FIG. 3C. Specifically, an ejection port forming member 18 made of a photosensitive resin is stacked on one side of a substrate 19 made of Si, and a support member 20 is joined to the other side of the substrate 19. The ejection ports 12 are formed in the ejection port forming member 18, and the pressure chambers 13 communicating with the ejection ports 12 are formed inside the ejection port forming member 18. The heaters 11 are disposed on the one side of the substrate 19, and a common supply channel 16 for the ink and a common recovery channel 17 for the ink are formed inside the substrate 19.

Furthermore, the substrate 19 is provided with the supply ports 14 each establishing communication between the common supply channel 16 and one side of the corresponding pressure chamber 13, and the recovery ports 15 each establishing communication between the common recovery channel 17 and the other side of the corresponding pressure chamber 13.

The common supply channel 16 and the common recovery channel 17 are formed to extend across the entire region in the y direction where the ejection ports 12 are arranged. As described later, a pressure of the ink is adjusted in such a way as to create a difference in pressure between the common supply channel 16 and the common recovery channel 17. When the ink is ejected from some of the ejection ports 12 in the ejection port row 22 in a printing operation, the difference in pressure generates a flow of the ink at the remaining ejection ports 12 in the ejection port row 22 which do not eject the ink. To be more precise, as indicated with arrows in FIG. 3C, the ink in the common supply channel 16 flows to the common recovery channel 17 through the supply port 14, the pressure chamber 13, and the recovery port 15. Foreign substances such as viscous ink and bubbles, which develop at the ejection port 12 and in the pressure chamber 13 due to evaporation of a volatile component in the ink through the ejection port 12, can be revered into the common recovery channel 17 by the above-described flow of the ink. In the meantime, the support member 20 has a function as a lid that constitutes part of walls of the common supply channel 16 and of the common recovery channel 17 in the substrate 19.

(Circulation Pathway for Ink)

Figure 4:
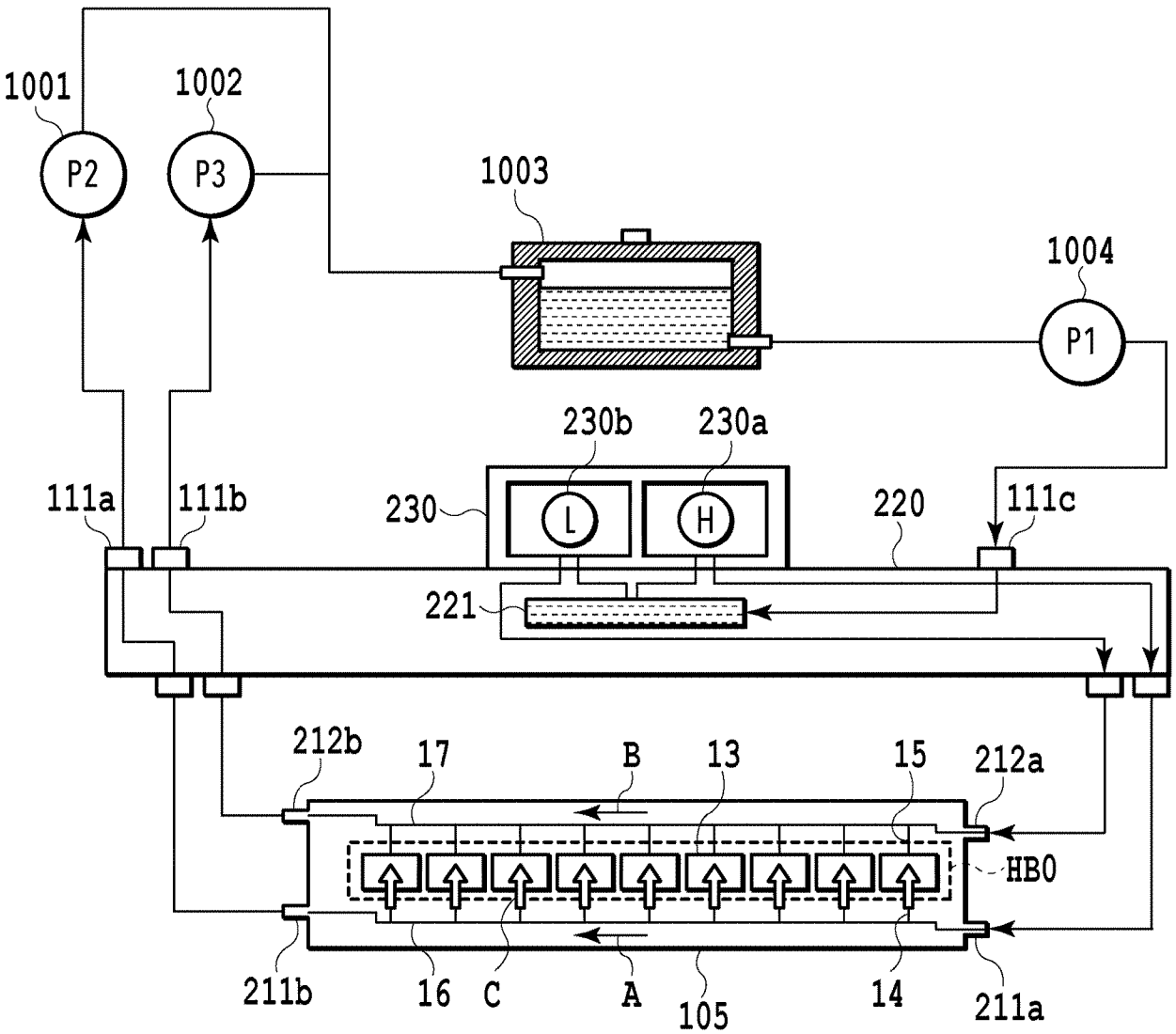
FIG. 4 is an explanatory diagram of a circulation pathway for an ink in the printing apparatus of FIG. 1.

FIG. 4 is an explanatory diagram of a circulation pathway for the ink to be applied to this embodiment. Since the circulation pathways for the ink in the printing heads 105 to 108 have the same structure, only the circulation pathway for the ink in the printing head 105 will be representatively explained below.

The ink in a main tank 1003 is supplied to the printing head 105 through a third circulation pump (P1) 1004 and a negative pressure control unit 230, and is then recovered into the main tank 1003 through a first circulation pump (P2) 1001 and a second circulation pump (P3) 1002. The above-mentioned series of passages for the supply and recovery of the ink will be referred to as the circulation pathway for the ink. The printing head 105 is connected to the first circulation pump (P2) 1001 on a high pressure side, the second circulation pump (P3) 1002 on a low pressure side, and the main tank (an ink tank) 1003 that stores the ink. The main tank 1003 can emit the bubbles in the ink to the outside through an atmosphere communication port (not shown) that establishes communication between the inside and outside of the main tank 1003. The ink in the main tank 1003 is consumed in the course of the printing operation of an image and a recovery operation (inclusive of preliminary eject, suction eject, pressurization eject, and the like) in order to keep a good ejection condition of the printing head. The main tank 1003 is taken away from the printing apparatus and replaced with another tank when the tank gets empty.

As described earlier, each of the heater boards HB0 to HB14 in the printing head 105 is provided with the common supply channel 16 and the common recovery channel 17, and the pressure chambers 13 establish communication between these channels through the supply ports 14 and the recovery ports 15. FIG. 4 illustrates only the heater board HB0 out of the heater boards HB0 to HB14. As a matter of fact, the heater boards HB0 to HB14 are connected in series in which the heater board HB0 is located on the most upstream side (the right side in FIG. 4) in a direction of circulation of the ink while the heater board HB14 is located on the most downstream side (the left side in FIG. 4) in the direction of circulation of the ink. In other words, among the heater boards HB0 to HB14, the one having a larger number is located more downstream in the direction of circulation of the ink.

The first circulation pump 1001 suctions the ink in the common supply channel 16 through a connection part 111*a* of the negative pressure control unit 230 and an outlet 211*b* of the printing head 105, and returns the suctioned ink to the main tank 1003. The second circulation pump 1002 suctions the ink in the common recovery channel 17 through a connection part 111*b* of the negative pressure control unit 230 and an outlet 212*b* of the printing head 105, and returns the suctioned ink to the main tank 1003. Each of the first circulation pump 1001 and the second circulation pump 1002 is preferably a positive displacement pump having a quantitative liquid transporting capacity. To be more precise, examples of the positive displacement pump include a tube pump, a gear pump, a diaphragm pump, a syringe pump, and the like. Alternatively, any of these circulation pumps may adopt a mode of securing a constant flow volume by installing a general constant flow valve or relief valve at an outlet of the pump.

When the printing head 105 is in operation, a certain amount of the ink is fed to the common supply channel 16 and the common recovery channel 17 in a direction of an arrow A (a supply direction) and a direction of an arrow B (a recovery direction) by using the first circulation pump 1001 and the second circulation pump 1002 as shown in FIG. 4, respectively. A flow volume of the ink is set to such an amount that can reduce a difference in temperature among the heater boards HB0 to HB14 to the extent that does not affect image quality of a printed image. However, if the flow volume is too large, a difference in negative pressure among the heater boards HB0 to HB14 may grow too large due to an influence of damage of flow passages in the printing head 105 due to pressure, thus leading to unevenness in density of the printed image. For this reason, it is preferable to set the flow volume of the ink in each of the common supply channel 16 and the common recovery channel 17 in consideration of the difference in temperature and the difference in negative pressure among the heater boards HB0 to HB14.

The negative pressure control unit 230 is provided on a flow passage between the third circulation pump 1004 and the printing head 105. The negative pressure control unit 230 has a function to keep the pressure of the ink in the printing head 105 constant even when the flow volume of the ink in the ink circulation system varies depending on the density of the printed image (which corresponds to the eject amount of the ink). Two pressure adjustment mechanisms 230*a* and 230*b* constituting the negative pressure control unit 230 only need to have a structure that can control the pressure in the flow passage on the downstream side thereof within a predetermined range based on a desired set pressure as a median, and any mechanism is applicable based on this perspective. For example, each pressure adjustment mechanism may adopt a mechanism similar to a so-called pressure reducing regulator. In the case of using the pressure reducing regulator, it is preferable to apply a pressure to the inside of a flow passage on the upstream side of the negative pressure control unit 230 through an ink supply unit 220 by using the third circulation pump 1004 as shown in FIG. 4. In this way, it is possible to increase the degree of layout freedom of the main tank 1003 in the printing apparatus while suppressing an adverse effect of a water head pressure between the main tank 1003 and the printing head 105 on the printing apparatus.

The third circulation pump 1004 is connected to the pressure adjustment mechanisms 230*a* and 230*b* through a connection part 111*c* of the negative pressure control unit 230 and a filter 221. The third circulation pump 1004 only needs to have a lifting pressure equal to or above a certain pressure within a range of a circulation flow volume of the ink when the printing head 105 is in operation, and a turbo pump, a positive displacement pump or the like can be used. A diaphragm pump and the like are applicable, for example. Here, instead of the third circulation pump 1004, it is also possible to apply a water head tank that is installed so as to ensure a certain water head pressure relative to the negative pressure control unit 230.

Control pressures that are different from each other are set to the two pressure adjustment mechanisms 230*a* and 230*b* in the negative pressure control unit 230, respectively. The pressure adjustment mechanism 230*a* is set to a relatively high pressure and is therefore indicated with "H" in FIG. 4, while the pressure adjustment mechanism 230*b* is set to a relatively low pressure and is therefore indicated with "L" in FIG. 4. The pressure adjustment mechanism 230*a* is connected to an inlet 211*a* of the common supply channel 16 for the ink in the printing head 105 through the inside of the supply unit 220. The pressure adjustment mechanism 230*b* is connected to an inlet 212*a* of the common recovery channel 17 for the ink in the printing head 105 through the inside of the supply unit 220.

As described above, as a consequence of connecting the pressure adjustment mechanism 230*a* on the high pressure side to the inlet 211*a* of the common supply channel 16 and connecting the pressure adjustment mechanism 230*b* on the low pressure side to the inlet 212*a* of the common recovery channel 17, a difference in negative pressure is created between the common supply channel 16 and the common recovery channel 17. For this reason, part of the ink flowing in the direction of the arrow A in the common supply channel 16 and in the direction of the arrow B in the common recovery channel 17 flows in a direction of arrows C through the supply ports 14, the pressure chambers 13, and the recovery ports 15.

As described above, in the printing head 105, the ink flows in the directions of the arrows A and B in the common supply channel 16 and the common recovery channel 17 of each of the heater boards HB0 to HB14. Accordingly, the flow of the ink in the common supply channel 16 and the common recovery channel 17 can release heat generated in each of the heater boards HB0 to HB14 to the outside.

(Printing Control System)

Figure 5:
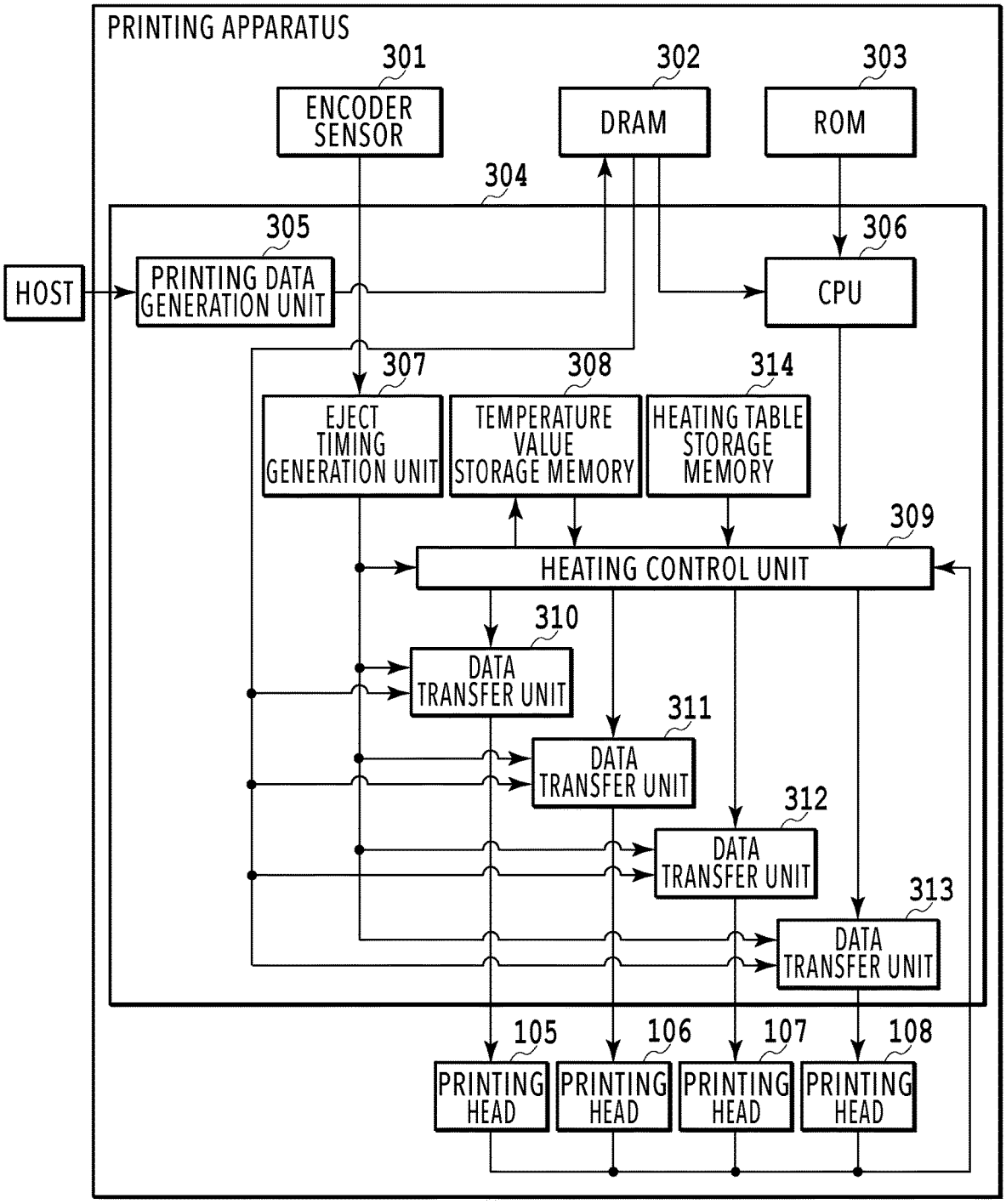
FIG. 5 is a block diagram of a control system of the printing apparatus of FIG. 1.

FIG. 5 is an explanatory diagram of a printing control system of the printing apparatus of this embodiment. Note that only the printing control system related to the printing head 105 out of the printing heads 105 to 108 will be representatively explained below.

The printing apparatus includes an encoder sensor 301, a DRAM 302, a ROM 303, a controller (an ASIC) 304, and the printing heads 105 to 108. The controller 304 is provided with a printing data generation unit 305, a CPU 306, an eject timing generation unit 307, a temperature value storage memory 308, a heating control unit 309, a heating table storage memory 314, and data transfer units 310 to 313. The CPU 306 reads and executes programs stored in the ROM 303, thereby controlling operations of the entire printing apparatus including activation of drivers of respective motors and the like. Meanwhile, in addition to various control programs to be executed by the CPU 306, the ROM 303 stores fixed data necessary for various operations of the printing apparatus. For example, programs used for executing printing control of the printing apparatus are stored therein.

The DRAM 302 is used as a work area for the CPU 306, as well as a temporary storage area for various reception data and a memory area for various setting data. Here, two or more DRAMs 302 may be installed or both the DRAM and an SRAM may be installed to constitute a unit including multiple memories with difference access speeds. The printing data generation unit 305 executes color conversion processing, quantization processing, and the like on image data received from a host device (a PC) located outside the printing apparatus, thereby generating printing data used for causing the printing heads 105 to 108 to eject the inks and storing the generated data in the DRAM 302.

The encoder sensor 301 detects a relative position between each of the printing heads 105 to 108 and the printing medium P. The eject timing generation unit 307 generates eject timing information, which indicates eject timings of the respective inks in the printing heads 105 to 108 as described later, based on positional information detected by the encoder sensor 301. The four data transfer units 310 to 313 read the printing data stored in the DRAM 302 in accordance with the eject timings generated by the eject timing generation unit 307. Temperature information on the respective heater boards HB0 to HB14 in the respective printing heads 105 to 108 is stored in the temperature value storage memory 308. The heating control unit 309 generates heating information for determining heating conditions applicable to the respective heater boards HB0 to HB14 based on the temperature information stored in the temperature value storage memory 308 and on a table stored in the heating table storage memory 314.

The data transfer units 310 to 313 transfer these printing data and the heating information to the printing heads 105 to 108, respectively. The printing heads 105 to 108 drive the ink eject heaters 11 based on the printing data while performing various heating actions based on the heating information, thereby ejecting the inks in the pressure chambers from the ejection ports 12 corresponding to the heaters 11. The temperature detected with the temperature sensor 24 in each heater board in each of the printing heads 105 to 108 is inputted to the heating control unit 309. The heating control unit 309 updates the temperature information by storing the temperature information newly detected with the temperature sensor 24 into the temperature value storage memory 308. The temperature information is thus updated and used at the time of generation of the subsequent heating information.

(Influence on Image by Thickening of Ink)

In the printing apparatus provided with the ink circulation pathway, when the ink causes thickening (an increase in concentration) in the vicinity of any of the ejection ports 12 due to evaporation of a volatile component in the ink from the ejection port 12 and the like, the thickened ink is removed from the vicinity of the ejection port 12 through the circulation pathway. As a consequence, the progress in ink thickening is avoided just in the vicinity of the ejection port 12. However, the thickening of the ink is apt to progress gradually in the ink circulation pathway as a whole. When the thickening of the ink progresses as described above, the viscosity of the ink is increased whereby the ink concentration becomes higher. Accordingly, a difference in printing density on the image between before the thickening of the ink and after the thickening of the ink may occur if the image is printed by ejecting the same number of ink droplets on the printing medium.

Figure 6:
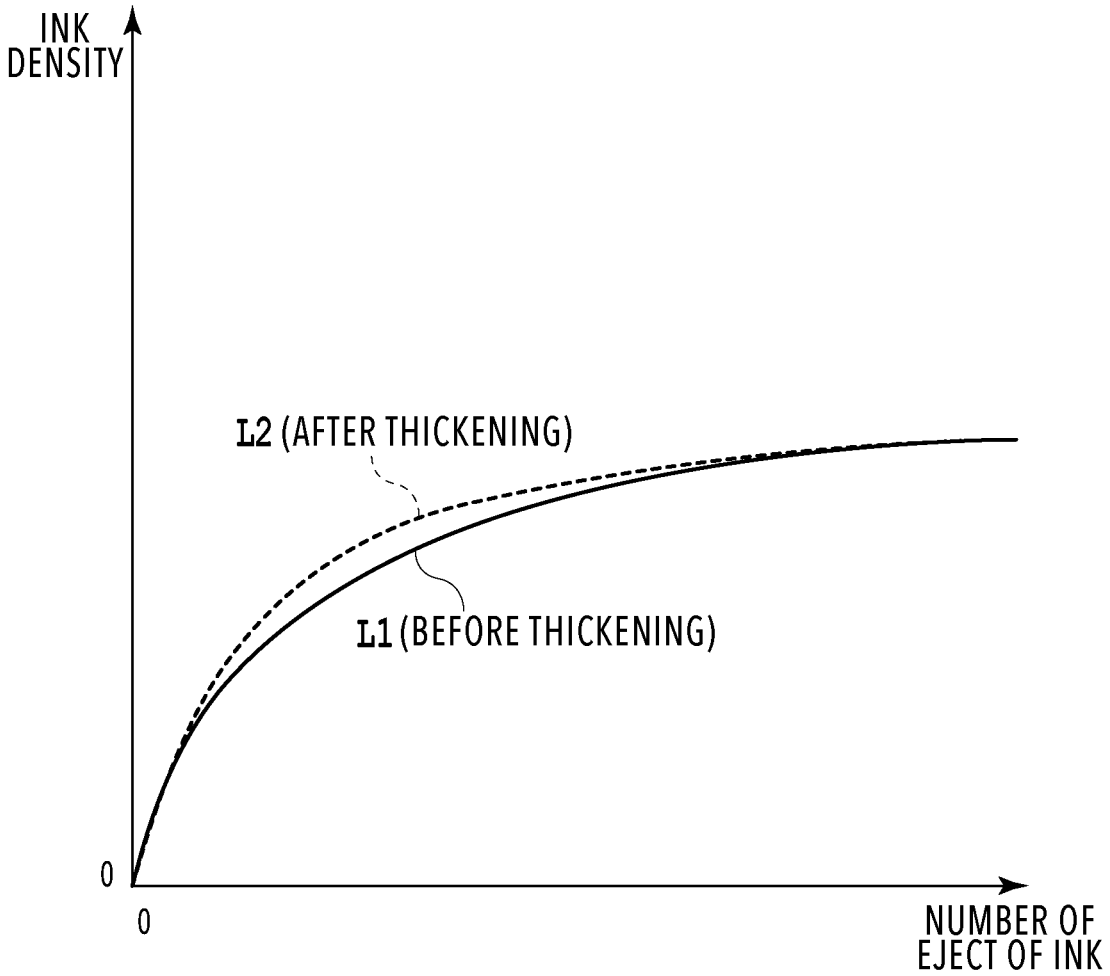
FIG. 6 is an explanatory diagram of a relation between a concentration of the ink and the number of eject thereof.

FIG. 6 is an explanatory diagram of a relation between the number of eject of the ink and a printing density. Here, a curve L1 represents a relation between the number of eject of the ink and the printing density before the thickening of the ink while a curve L2 represents a relation between the number of eject of the ink and the printing density after the thickening of the ink. After the thickening of the ink, the printing density of the image becomes higher than that before the thickening since each ink droplet has a higher concentration.

When an image with a bright tone is printed on the printing medium by ejecting the ink droplets sufficiently away from one another, a difference in printing density tends to be more conspicuous on the image before and after the thickening of the ink. In the meantime, when an image with such a tone that fills the surface on the printing medium with the ink droplets, the difference in printing density on the image becomes less before and after the thickening of the ink. This tendency brings about a change in tone characteristic of the printed image before and after the thickening of the ink. Meanwhile, the ink with the increased viscosity due to the thickening of the ink contains less moisture. Accordingly, components other than the moisture such as a solvent contained in the ink are more likely to stay on the printing medium than they do before the thickening of the ink. In particular, when the ink is a pigment ink that contains a pigment component, an amount of deposition of the pigment component on the printing medium is increased. Here, the solvent and the pigment deposited on the printing medium are more likely to fall off. As a consequence, if the pigment ink after the increase in viscosity is ejected onto the printing medium in the same manner as that before the increase in viscosity, the image printed on the printing medium is prone to deterioration in rub fastness that may get the inside of the printing apparatus dirty. In the meantime, the hands of a user may get dirty if the user touches such a printed material.

(Image Processing)

Figure 7:
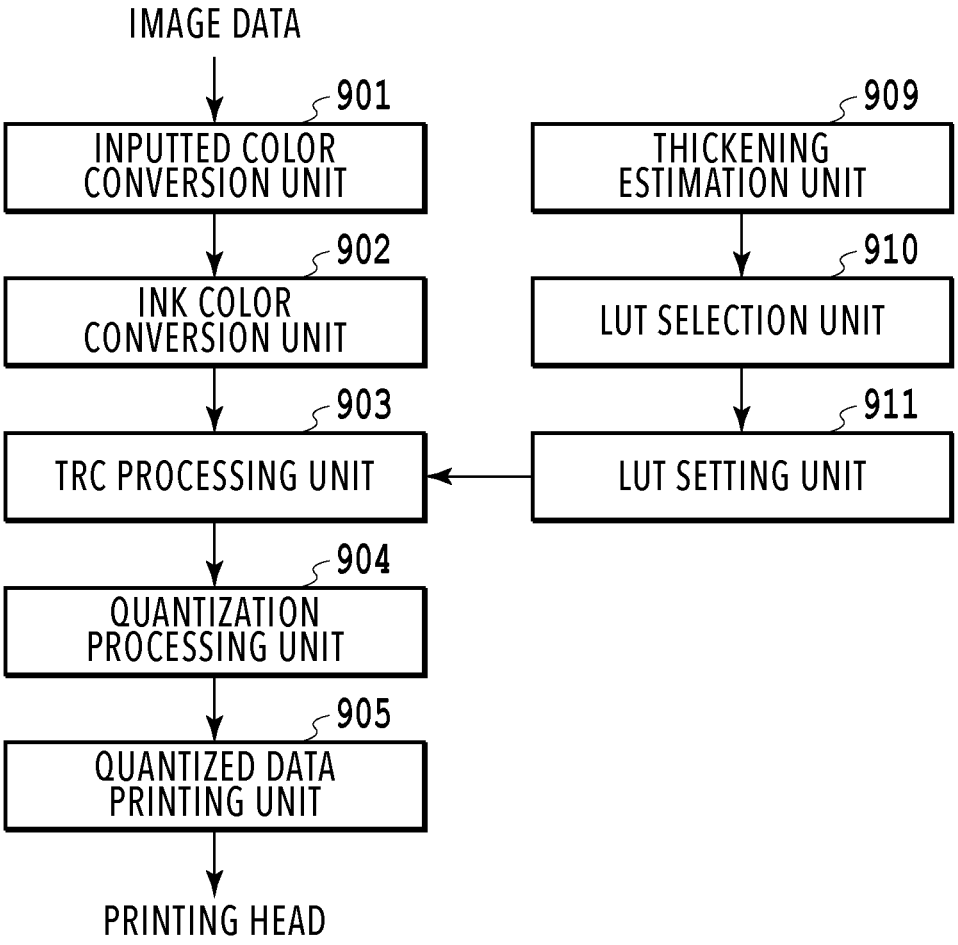
FIG. 7 is an explanatory diagram of image processing by the printing apparatus of FIG. 1.

FIG. 7 is an explanatory diagram of image processing in this embodiment.

An inputted color conversion unit 901 converts inputted image data into image data corresponding to a color reproduction range of the printing apparatus. In the case of this embodiment, the image data to be inputted are data indicating color coordinates (R, G, B) in color space coordinates such as the sRGB representing colors to be expressed with a monitor. The inputted color conversion unit 901 converts inputted image data R, G, B each composed of 8 bits into image data (R', G', B') within the color reproduction range of the printing apparatus in accordance with a known method such as matrix operation processing and processing by using a three-dimensional LUT. In this embodiment, the conversion processing is conducted by use of a three-dimensional lookup table (3DLUT) and an interpolation operation at the same time.

An ink color conversion unit 902 converts the image data (R', G', B') each composed of 8 bits and processed by the inputted color conversion unit 901 into image data corresponding to color signal data of the inks used in the printing apparatus. Since black (K), cyan (C), magenta (M), and yellow (Y) inks are used in this embodiment, the image data formed of RGB signals are converted into the image data of 8-bit color signals corresponding to K, C, M, and Y, respectively. Moreover, in this embodiment, the above-described color conversion processing is conducted by use of the three-dimensional lookup table and the interpolation operation at the same time as with the processing with the inputted color conversion unit 901. Here, a method such as the matrix operation processing can also be used as another method of color conversion. In the meantime, the number of colors of the inks is not limited to the four colors of K, C, M, and Y, and it is also possible to use other inks with less concentrations such as light cyan (Lc), light magenta (Lm), and gray (Gy).

A tone reproduction curve (TRC) processing unit 903 processes the image data formed of the ink color signals each composed of 8 bits and processed by the ink color conversion unit 902. In other words, the TRC processing unit 903 conducts correction for adjusting the number of dots to be formed for each of the ink colors by a quantized data printing unit 905. To be more precise, since the numbers of dots to be formed on the printing medium and optical densities on the printing medium realized in accordance with the numbers of dots are not in linear relationships, the numbers of dots to be formed on the printing medium are adjusted by correcting the image data each composed of 8 bits so as to establish the linear relationships among them. A typical method of converting the inputted data into output data is a method of using a one-dimensional lookup table (LUT). In this embodiment, the LUT is used as the source of correction parameters of the TRC processing unit 903.

A quantization processing unit 904 generates 1-bit binary data, which represents either a print "1" or a non-print "0", by subjecting each piece of the image data of the respective colors, the piece being composed of 8 bits (256 values) processed by the TRC processing unit 903. An output from the above-described quantization processing may also be defined as the number of eject of the ink per unit area. In the meantime, various methods including an error diffusion method and a dither method can be used as the quantization method. The quantized data printing unit 905 ejects the inks of the respective colors on the printing medium and thus prints the image thereon by operating the printing heads based on the binary data (dot data) generated by the quantization processing unit 904.

(Method of Correcting Printing Density)

As described above, the TRC processing unit 903 adjusts the numbers of dots to be formed on the printing medium by correcting the image data so as to establish the linear relationships among the numbers of dots to be formed on the printing medium and the optical densities on the printing medium realized in accordance with the numbers of dots. However, if the gradation characteristics are changed due to the thickening of the ink as shown in FIG. 6, the numbers of dots adjusted by the TRC processing unit 903 cannot maintain the linear relationships with the optical densities on the printing medium.

If the linear relationships are no longer maintained as mentioned above, the image quality of the printed image is affected by imbalance in color thereof. Furthermore, thickening rates of the inks may vary among the inks of the respective colors. The thickening of the ink that develops in the vicinity of any of the ejection ports 12 progresses gradually into the entire circulation pathway along with the circulation of the ink. The above-described thickening of the ink progresses faster as the ink of a certain color has the larger number of the ejection ports 12 that are not used for the ink eject. For instance, the cyan ink is not used very much in the case of printing a large number of formats containing red images. In this case, the thickening of the cyan ink progresses faster than the inks of other colors.

For this reason, concentration information concerning the degrees of thickening of the inks as mentioned above is either estimated or detected, and the LUT to be used by the TRC processing unit 903 is switched based on the concentration information.

Figure 16:
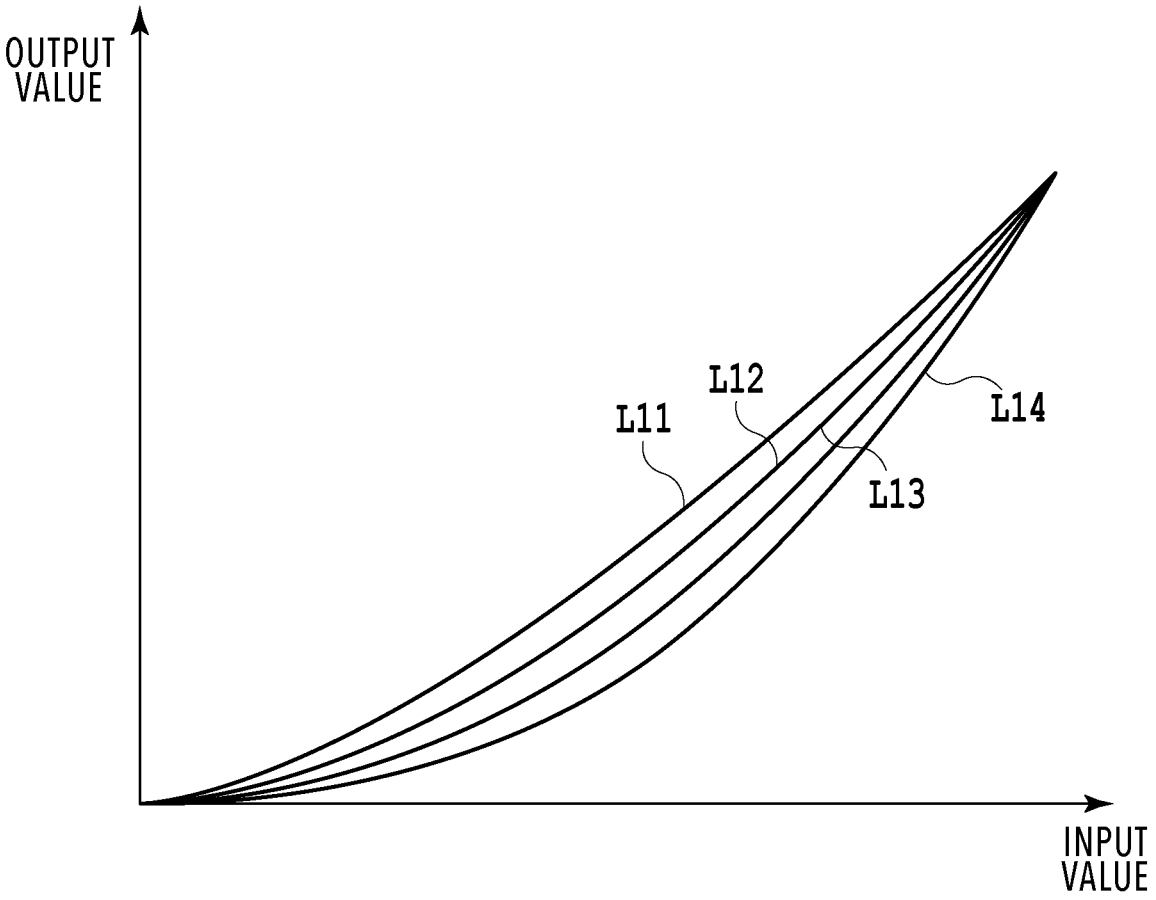
FIG. 16 is an explanatory diagram of a lookup table to be used by a TRC processing unit of FIG. 7.

For example, as shown in FIG. 16, four LUTs (LUTs having conversion characteristics represented by curves L11, L12, L13, and L14) having different degrees of adjustment for the number of dots to be formed on the printing medium are prepared and one of these LUTs is selected and used depending on the information on the ink concentration. In FIG. 16, the horizontal axis indicates the ink color signals (input signals) each composed of 8 bits and processed by the ink color conversion unit 902 while the longitudinal axis indicates the ink color signals (output signals) each composed of 8 bits and corrected by the TRC processing unit 903. The conversion characteristics L11, L12, L13, and L14 are preset while being associated with ink thickening information. The LUT having the conversion characteristic L14 is used when the concentration of the ink is in an initial state, and one of the LUTs having the conversion characteristics L13, L12, and L11 is used in accordance with an increase in ink concentration. For example, the LUT having the conversion characteristic L13 is used when the concentration of the ink is increased by 4% from the initial state, and the LUT having the conversion characteristic L12 is used when the concentration of the ink is increased by 8% from the initial state. Furthermore, the LUT having the conversion characteristic L11 is used when the concentration of the ink is increased by 12% from the initial state.

As described above, in this embodiment, the thickening of the ink is estimated by a thickening estimation unit 909 shown in FIG. 7 and an LUT selection unit 910 selects an appropriate LUT based on a result of the estimation. An LUT setting unit 911 sets the selected LUT as the LUT to be used by the TRC processing unit 903. When the printing operation is executed while leaving the progress in ink thickening as it stands, the density of the printed image is changed and the rub fastness of the printed image is deteriorated along with the progress in ink thickening, whereby the inside of the printing apparatus may get dirty. For this reason, the LUT is switched in such a way as to reduce the number of eject of the ink (the number of ink droplets to be ejected per unit printing area) as the ink is thickened more. Moreover, it is also possible to maintain the tone characteristic of the printed image by taking the tone characteristic into consideration in the above-mentioned situation.

As described above, the thickening of the ink gradually progresses in the circulation pathway for the ink. Accordingly, it is preferable to switch the LUT not only in the course of the printing operation on a certain page of the printing medium, but also in the course of sequential printing operations depending on the ink thickening information. For example, the LUTs corresponding to the inks at different concentrations are generated in advance in a laboratory, and are stored in a main unit of the printing apparatus. Then, the LUT to be used is selected and switched among those LUTs depending on the ink thickening information. In this way, it is possible to maintain the linearly of the relationship between the number of dots and the optical density. Alternatively, the aforementioned LUTs as the correction parameters do not have to be stored in advance, but may be generated by the main unit of the printing apparatus based on ink concentration information. Here, it is preferable to switch the LUTs for each of the ink colors because thickening conditions vary among the ink colors.

(Detection of Ink Concentration)

As an example of a method of detecting the ink concentration, there is a method of deploying a sub tank on the ink circulation pathway in addition to the main tank, and detecting the concentration of the ink inside the sub tank with a concentration sensor. As the concentration sensor, it is possible to use a sensor designed to feed the ink into a transparent cell such as space between glass plates and to measure an amount of light transmission while illuminating the cell, thereby measuring the ink concentration corresponding to the amount of light transmission. Alternatively, it is also possible to apply an electric current to the ink and to detect the ink concentration based on its electric conductivity. The information detected in accordance with any of these methods will be referred to as the concentration information as well.

(Estimation of Ink Concentration)

Information concerning an evaporation amount V of the ink in the ink circulation pathway, an consumption amount In of the ink, and an initial amount J of the ink (evaporation amount information, consumption amount information, and initial amount information) are acquired in this embodiment (evaporation amount acquisition, consumption amount acquisition, and initial amount acquisition). Then, the concentration information concerning the ink concentration is acquired (concentration acquisition) based on these pieces of information. The concentration information is acquired for each type of the inks. In the following, processing for acquiring the concentration information on the ink of a certain color will be representatively described in three categories of "1. Calculation of ink evaporation amount", "2. Calculation of ink consumption amount", and "3. Calculation of ink concentration".

1. Calculation of Ink Evaporation Amount

In this embodiment, an ink evaporation amount Vx during a printing operation and an ink evaporation amount Vy during a non-printing operation are calculated to begin with. Then, a sum of these amounts are defined as a total evaporation amount V (=Vx+Vy).

Figure 8:
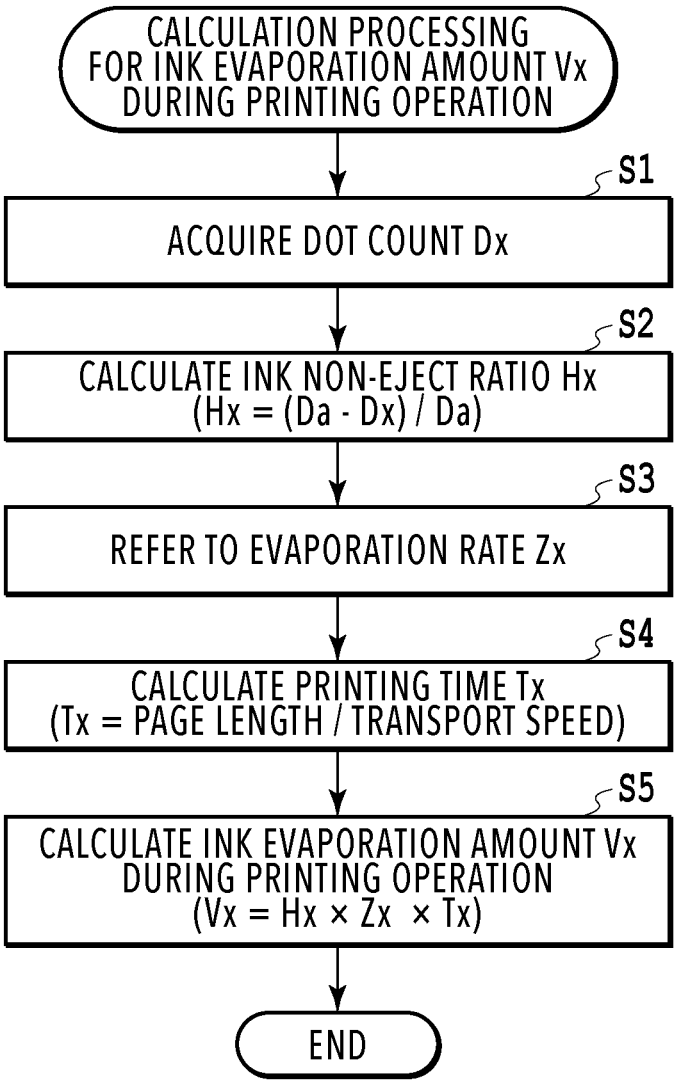
FIG. 8 is a flowchart for explaining calculation processing for an ink evaporation amount during a printing operation.

1-1. Calculation Processing for Ink Evaporation Amount Vx During Printing Operation FIG. 8 is a flowchart for explaining the calculation processing for the ink evaporation amount Vx during the printing operation. This calculation processing is executed in accordance with a control program of this embodiment. Here, an ink non-eject ratio Hx, an ink evaporation rate Zx, and a printing time Tx are sought in order to calculate the ink evaporation amount Vx.

The calculation processing for the ink evaporation amount Vx is started upon receipt of printing start information. First, a dot count Dx is calculated by counting the number of eject of the ink (counting the dots) in one page of the printing medium (step S1). Then, the ink non-eject ratio Hx is calculated (step S2). The ink non-eject ratio Hx corresponds to a ratio of pixels not ejecting the ink relative to all pixels capable of ejecting the ink. To be more precise, a case where the ink is ejected from all the ejection ports is defined as "1". And the dot count Dx of the actual ink eject is subtracted from the dot count Da at the case where the ink is ejected from all the ejection ports, and a value obtained by dividing such an obtained subtraction value by the dot count Da is defined as the ink non-eject ratio Hx. The ink non-eject ratio Hx is obtained for each of the ink colors.

Next, the ink evaporation rate Zx is referred (step S3). An evaporation mount of the ink per second has been measured in advance and this evaporation amount is stored in the heating table storage memory 314 in advance as the evaporation rate Zx. The higher the temperature is, the more the ink is prone to evaporate and the evaporation rate Zx becomes a larger value accordingly. The following table 1 shows specific values of the evaporation rate Zx in this embodiment. The evaporation rate Zx is set to 40 μg/sec when the temperature of the heater board is below 25° C., 150 μg/sec when the temperature of the heater board is equal to or above 25° C. and below 40° C., and 420 μg/sec when the temperature of the heater board is equal to or above 40° C.

TABLE 1

| Evaporation rate | Regulation temperature [° C.] | | |
|---|---|---|---|
| [μg/sec] | below 25 | below 40 | 40 or above |
| Zx | 40 | 150 | 420 |

Next, the printing time Tx required for printing one page of the printing medium is calculated (step S4). Specifically, the printing time Tx is calculated by dividing a length of one page of the printing medium by a transport speed. Next, the ink evaporation amount Vx during the printing operation is calculated (step S5). Specifically, the ink evaporation amount at the time of printing on one page of the printing medium is calculated by multiplying the non-eject ratio Hx by the evaporation rate Zx and by the printing time Tx. Then, the ink evaporation amount Vx during a sequence of the printing operation is calculated by repeating and accumulating the value of the calculation of the evaporation amount for every page to be printed during the sequence of the printing operation.

Figure 9:
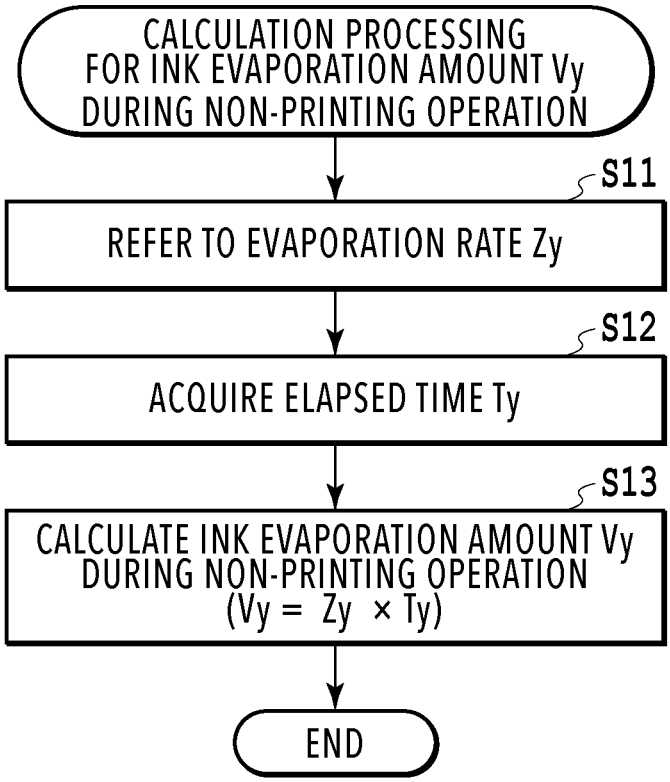
FIG. 9 is a flowchart for explaining calculation processing for the ink evaporation amount during a non-printing operation.

1-2. Calculation Processing for Ink Evaporation Amount Vy During Non-Printing Operation FIG. 9 is a flowchart for explaining the calculation processing for the ink evaporation amount Vy during the non-printing operation. This calculation processing is executed in accordance with the control program of this embodiment. Here, an ink evaporation rate Zy and an elapsed time Ty of the non-printing operation are sought in order to calculate the ink evaporation amount Vy.

First, the ink evaporation rate Zy is referred (step S11). An evaporation mount of the ink per minute during the non-printing operation has been measured in advance and this evaporation amount is stored in the heating table storage memory 314 in advance as the evaporation rate Zy. The higher the temperature is, the more the ink is prone to evaporate and the evaporation rate Zy becomes a larger value accordingly. In terms of the same lapse of time, the evaporation rate during the non-printing operation is smaller than that during the printing operation because the ejection ports 12 of the printing heads 105 to 108 are covered with cap members. The following table 2 shows specific values of the evaporation rate Zy in this embodiment. The evaporation rate Zy is set to 1 μg/min when the temperature of the heater board is below 15° C., 2 μg/min when the temperature of the heater board is equal to or above 15° C. and below 25° C., and 5 μg/min when the temperature of the heater board is equal to or above 25° C.

TABLE 2

| Evaporation rate | Environmental temperature [° C.] | | |
|---|---|---|---|
| [μg/sec] | below 15 | below 25 | 25 or above |
| Zy | 1 | 2 | 5 |

Next, the elapsed time Ty during the non-printing operation is calculated (step S12), and then the ink evaporation amount Vy during the non-printing operation is calculated (step S13). Specifically, the evaporation amount Vy is calculated by multiplying the evaporation rate Zy by the elapsed time Ty.

The total evaporation amount V is calculated by adding the ink evaporation amount Vx during the printing operation and the ink evaporation amount Vy during the non-printing operation obtained as described above.

2. Calculation of Ink Consumption Amount

Figure 10:
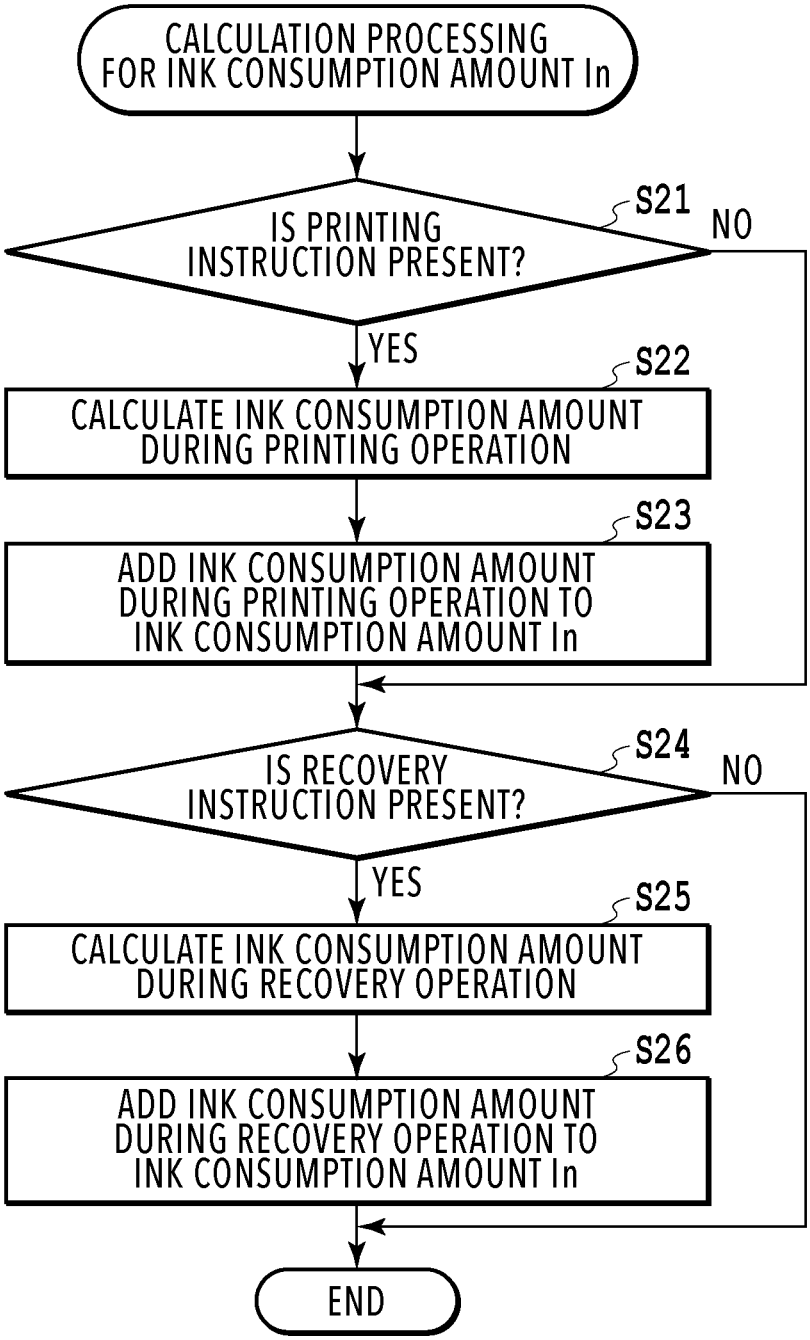
FIG. 10 is a flowchart for explaining calculation processing for an ink consumption amount.

FIG. 10 is a flowchart for explaining calculation processing for an ink consumption amount In during the printing operation and the non-printing operation. This calculation processing is executed in accordance with the control program of this embodiment.

First, it is determined whether or not a printing instruction is present (step S21). The processing proceeds to step S24 to be described later if the printing instruction is not present. When the printing instruction is present, the ink consumption amount during the printing operation is calculated from the dot count and the like (step S22), and such a calculated ink consumption amount is added to the ink consumption amount In (step S23). Next, it is determined whether or not a recovery instruction is present (step S24). The calculation processing for the ink consumption amount In is terminated if the recovery instruction is not present. When the recovery instruction is present, the ink consumption amount at the actual recovery operation is calculated by referring to an ink consumption amount to be consumed in a unit recovery operation stored in the memory in advance (step S25), and such a calculated ink consumption amount is added to the ink consumption amount In (step S26).

As described above, in this embodiment, the ink consumption amount in the ink circulation pathway is managed by adding the ink consumption amount during any of the printing operation and the recovery operation to the ink consumption amount In every time any of the printing instruction and the recovery instruction is present.

3. Calculation of Ink Concentration

Figure 11:
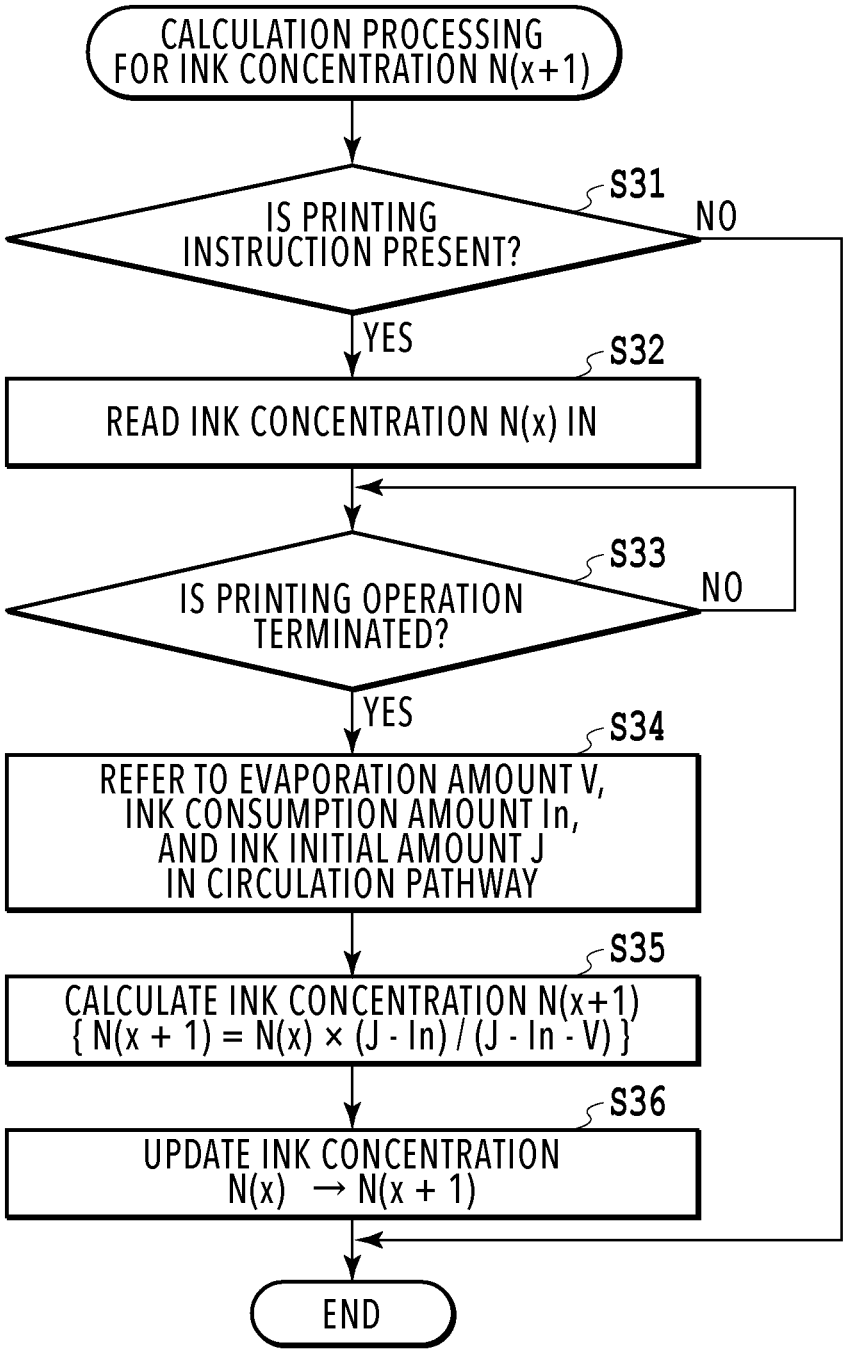
FIG. 11 is a flowchart for explaining calculation processing for an ink concentration.

FIG. 11 is a flowchart for explaining calculation processing for the ink concentration in the ink circulation pathway. This calculation processing is executed in accordance with the control program of this embodiment.

First, it is determined whether or not the printing instruction is present (step S31). The processing is terminated if the printing instruction is not present. When the printing instruction is present, an ink concentration N(x) calculated in precedent calculation processing for the ink concentration is read (step S32). The following table 3 shows specific values of ink concentration initial values (initial concentrations) Nref in this embodiment.

TABLE 3

| | Color | | | |
|---|---|---|---|---|
| | Bk | Cy | Ma | Ye |
| Nref | 0.08 | 0.06 | 0.06 | 0.06 |

Next, it is determined whether or not the printing operation is terminated (step S33). The processing proceeds to step S34 after the termination of the printing operation, in which the evaporation amount V and the ink consumption amount In obtained as described above, as well as the ink initial amount J are referred (step S34). After the termination of the printing operation, the recovery operation is executed as needed. The ink initial amount J in the ink circulation pathway is a value which is predetermined in terms of the shape of the circulation pathway and the ink type. The following table 4 shows specific values of the initial amounts J in this embodiment.

TABLE 4

| | Color | | | |
|---|---|---|---|---|
| | Bk | Cy | Ma | Ye |
| J [g] | 194 | 188 | 185 | 183 |

Next, an ink concentration N(x+1) after the recent printing operation and recovery operation (hereinafter referred to as after the printing/recovery operation) is calculated based on the evaporation amount V, the ink consumption amount In, the ink initial amount J, and the ink concentration N(x) calculated in the previous calculation processing (step S35). In the following description, an ink amount in the circulation pathway before the recent printing operation and recovery operation (before the printing/recovery operation) is defined as J(x). When the ink is a pigment ink, an amount of a pigment in the ink that is present in the circulation pathway at a stage before the printing/recovery operation is expressed as {N(x)×J(x)} where N(x) represents the concentration and J(x) represents the ink amount.

Meanwhile, after the printing/recovery operation, the ink is decreased by a sum of the ink consumption amount In associated with the recent printing operation and recovery operation and the evaporation amount V. Accordingly, the ink amount after the printing/recovery operation is expressed as {J(x)−In−V}. Here, based on a relation with the ink concentration N(x+1) at a stage after the printing/recovery operation, an amount of the pigment in the pigment ink at the stage after the printing/recovery operation is expressed as {N(x+1)×(J(x)−In−V)}. The pigment is also contained in the ink to be consumed in the recent printing operation and recovery operation. Accordingly, an amount of decrease in pigment with the printing operation and recovery operation is expressed as {N(x)×In} where N(x) represents the ink concentration and In represents the ink consumption amount. Since the pigment in the pigment ink does not evaporate, the ink amount V decreased by evaporation does not include any pigment.

As a consequence, a sum of the amount of the pigment in the pigment ink that is present in the ink circulation pathway after the printing/recovery operation and the amount of the pigment decreased in the recent printing operation and recovery operation is equal to the amount of the pigment present in the ink circulation pathway before the printing/recovery operation. It is possible to derive the following expression 1 from this relation:

$$N(x+1)\times(J(x)-In-V)+N(x)\times In=N(x)\times J(x). \quad \text{(Expression 1)}$$

The following expression 2 for calculating the ink concentration N(x+1) in the ink circulation pathway after the printing/recovery operation can be derived from the expression 1:

$$N(x+1)=N(x)\times(J(x)-In)/(J(x)-In-V). \quad \text{(Expression 2)}$$

Here, the ink amount J(x) is a significantly greater value than the ink consumption amount In and the evaporation amount V. Therefore, the term of the ink amount J(x) in the expression 2 can be approximated by the ink initial amount J. Accordingly, it is possible to derive the following expression 3:

$$N(x+1)=N(x)\times(J-In)/(J-In-V). \quad \text{(Expression 3)}$$

In this embodiment, the ink concentration N(x+1) after the printing/recovery operation is calculated based on the expression 3. Subsequently, the current concentration N(x) is updated with N(x+1) in step S36 in FIG. 11 and then the processing is terminated.

Alternatively, the concentration N(x+1) can be calculated by using the expression 2 not approximated by J(x). In this case, the ink amount J(x) in the ink circulation pathway before the printing/recovery operation needs to be calculated separately. However, it is possible to calculate the concentration N(x+1) more accurately since the approximation is not applied thereto.

As described above, the LUT selection unit 910 selects the LUT based on the calculated concentration N(x+1), and the LUT setting unit 911 sets the selected LUT as the LUT to be used by the TRC processing unit 903. As a consequence, the TRC processing unit 903 can adjust the number of dots so as to maintain the linear relationship with the optical density on the printing medium.

Second Embodiment

When the printing head is the elongated line head, ink eject characteristics may vary due to manufacturing tolerances and variations of nozzles to eject ink droplets, for example, thereby causing a difference in density on a printed image. In the second embodiment, a head shading processing (hereinafter also referred to as "HS processing") is carried out in order to correct such a difference in printing density.

Figure 12:
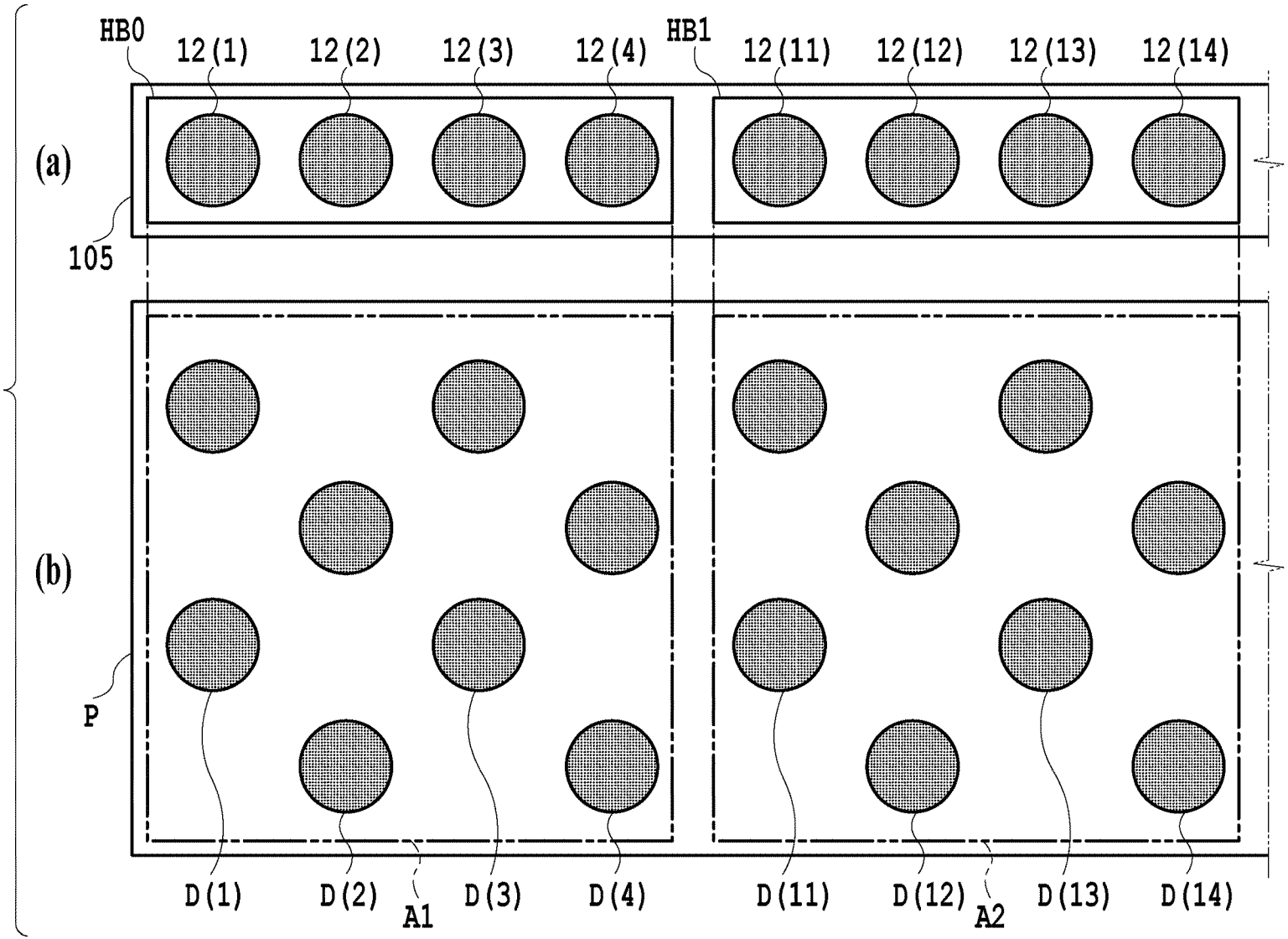
FIG. 12 is an explanatory diagram of a dot pattern formed in a case where amounts of eject of the ink from multiple ejection ports are equal.

FIG. 12 is an explanatory diagram of a layout pattern of dots D formed by the ink ejected from the ejection ports 12 in the elongated printing head (the line head) as shown in FIGS. 1 to 3C, in a case where amounts of eject of each ink droplet from the ejection ports 12 are entirely equal. Part (a) of FIG. 12 is a schematic diagram of the ejection ports 12 in the heater boards HB0 and HB1 of the printing head 105, in which the number of the ejection ports 12 in each heater board is set to four (12(1) to 12(4) and 12(11) to 12(14)) for the convenience of explanation. Part (b) of FIG. 12 is a schematic diagram of an image at a printing duty of 50% printed on the printing medium P with the ink ejected from the ejection ports 12 illustrated in part (a) of FIG. 12. Here, the number of the dots D to be formed is half as many as the number of dots in an image at a printing duty of 100%. Dots D(1) to D(4) are formed by the ink ejected from the ejection ports 12(1) to 12(4) while dots D(11) to D(14) are formed by the ink ejected from the ejection ports 12(11) to 12(14).

On the printing medium P, an area A1 on the left side of part (b) of FIG. 12 will be defined as a first area and an area A2 on the right side thereof will be defined as a second area. Meanwhile, in FIG. 12, the sizes of the ejection ports 12 and the dots D are shown equal to one another for the convenience of explanation. The amounts of eject of each ink droplet from the ejection ports 12 may also vary depending on other factors than the inside diameters of the ejection ports 12. However, in FIGS. 13 and 14 to be described below, each ejection port 12 with a large eject amount of the ink will be illustrated with a large circle while each ejection port 12 with a small eject amount of the ink will be illustrated with a small circle. In the meantime, each ink droplet ejected from each ejection port 12 includes a main droplet and a small droplet (a satellite droplet). However, explanation and illustration of such a small droplet will be omitted. A standard quantity of the ink is ejected in a standard direction from every ejection port 12 in part (a) of FIG. 12, and the dots D in the same size are formed at regular intervals on the printing medium P.

Figure 13:
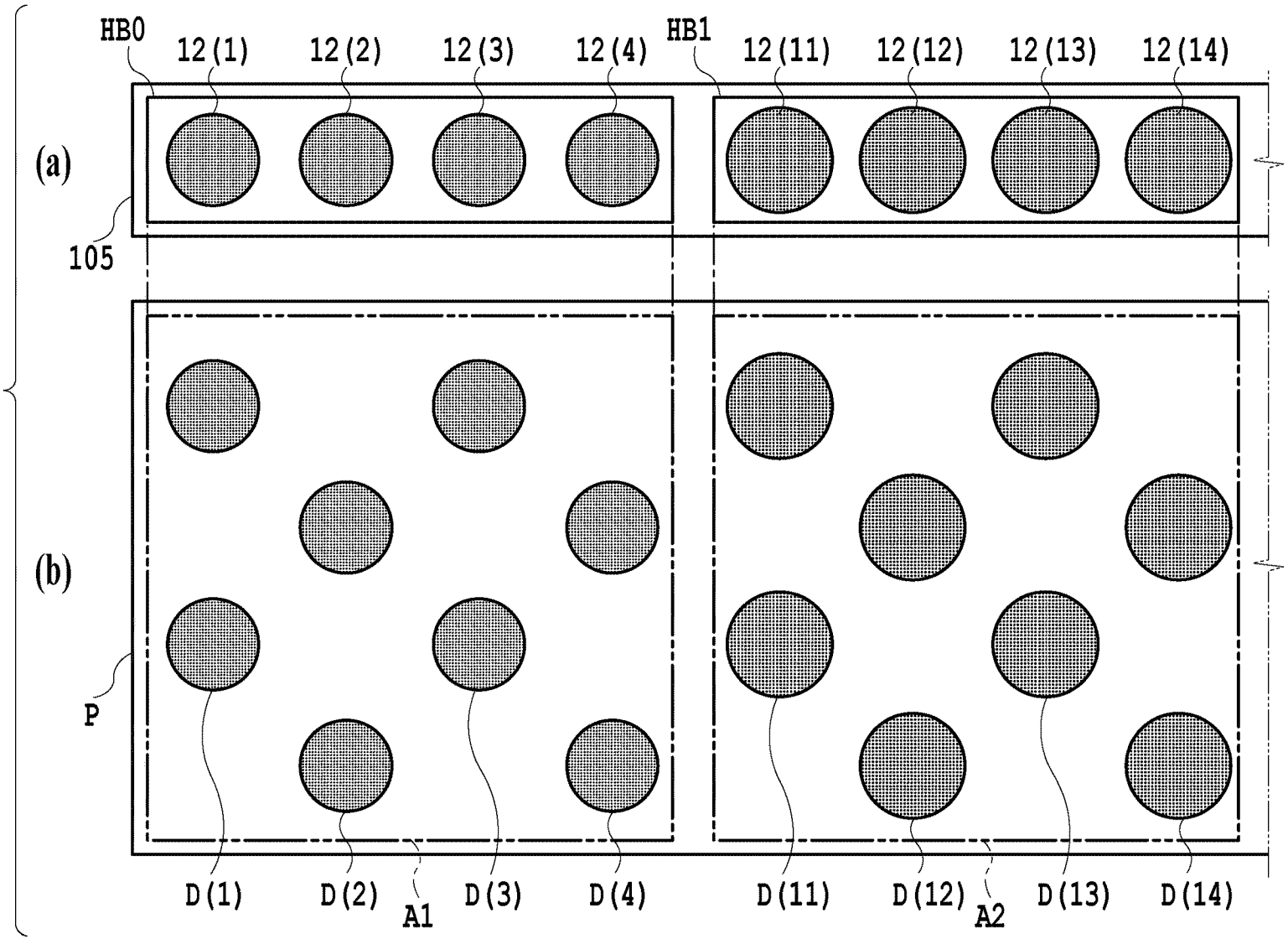
FIG. 13 is an explanatory diagram of a dot pattern formed in a case where the amounts of eject of the ink from the multiple ejection ports are different.

FIG. 13 is an explanatory diagram of a layout pattern of dots formed by the ink ejected from the ejection ports 12, in a case where an amount of eject of each ink droplet from each ejection port 12 in the heater board HB0 is different from an amount of eject of each ink droplet from each ejection port 12 in the heater board HB1. Part (a) of FIG. 13 is a schematic diagram of the ejection ports 12, and part (b) of FIG. 13 is a schematic diagram of an image at a printing duty of 50% formed on the printing medium P. The eject amount of the ink from each of the ejection ports 12 (12(1) to 12(4)) in the heater board HB0 is a standard eject amount while the eject amount of the ink from each of the ejection ports 12 (12(11) to 12(14)) in the heater board HB1 is larger than the standard eject amount. When the eject amounts of the ink are not even as described above, the image of the same color printed on the printing medium P brings about printing regions with different densities. In the example of FIG. 13, a solid image at a standard density is printed in the first area A1 on the left side while a solid image at a higher density is printed with the larger dots D in the second area A2 on the right side.

Figure 14:
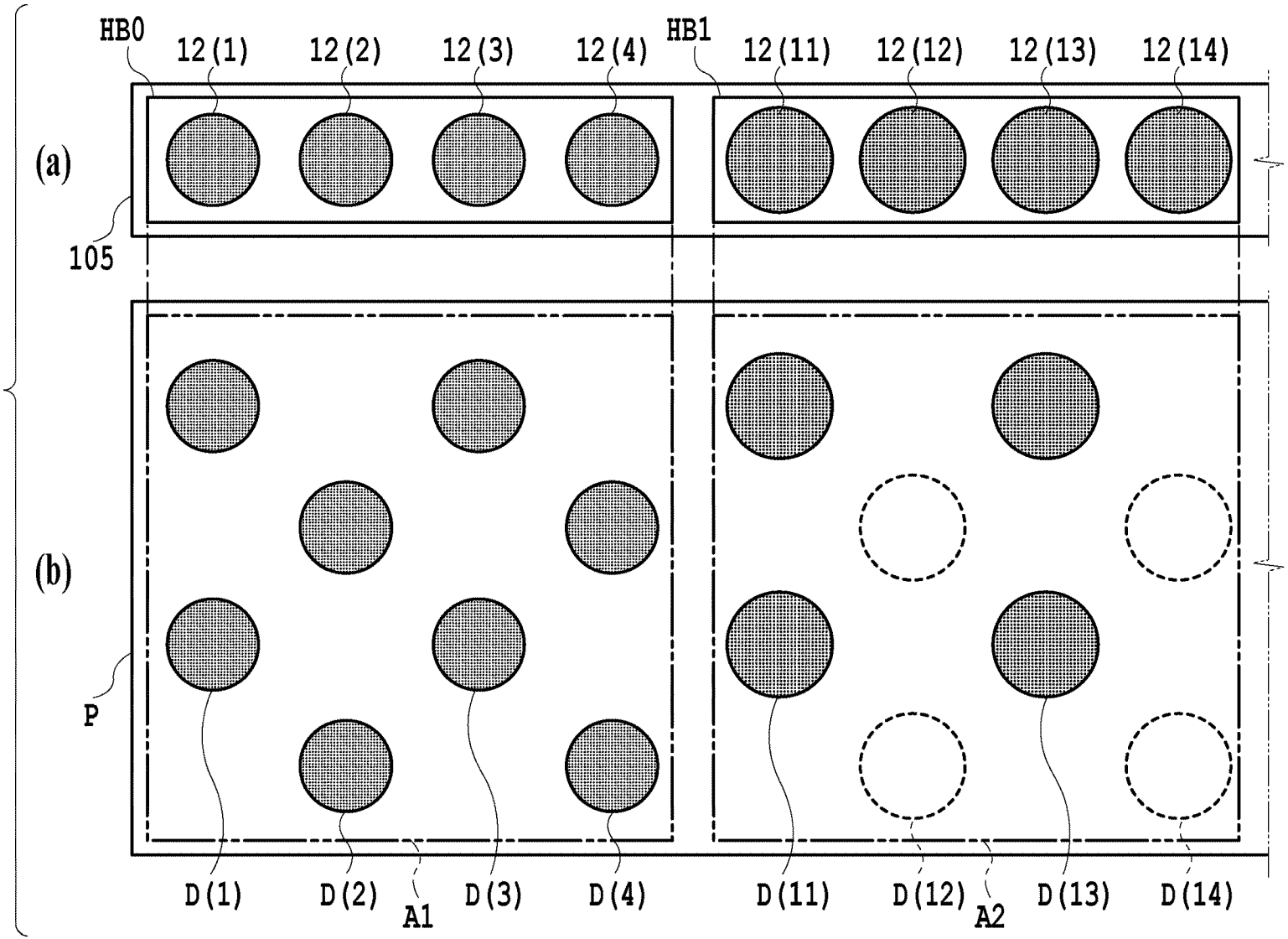
FIG. 14 is an explanatory diagram of a dot pattern formed after HS processing.

The image data is corrected by the HS processing in the case of using the printing head having the above-mentioned ink eject characteristics. Specifically, as shown in FIG. 14, the printing data corresponding to the heater board HB1 is subjected to the correction in such a way as to reduce the density of the image to be printed based on the printing data. Specifically, dot data representing the printing "1" of the dot and the non-printing "0" of the dot is generated in such a way as to reduce the number of the dots D to be formed by the heater board HB1 as compared to the number of the dots D to be formed by the heater board HB0.

Part (b) of FIG. 14 is a schematic diagram of an image to be printed as a consequence of conducting the HS processing on the printing data for printing the image at the printing duty of 50% by using the ejection ports 12 in the heater board HB1. In this embodiment, the area of the dots D (D(11) to D(14)) formed by the heater board HB1 is assumed to be twice as large as the area of the dots D (D(1) to D(4)) formed by the heater board HB0. In this case, the printing data is corrected by the HS processing such that the number of eject of the ink from the ejection ports 12 (12(11) to 12(14)) becomes about a half as many as the number of eject of the ink from the ejection ports 12 (12(1) to 12(4)) as shown in part (b) of FIG. 14. In this way, it is possible to substantially equalize the ink coverage area between the first area A1 and the second area A2.

As described above, the numbers of dots to be printed in the respective areas are adjusted by the HS processing in such a way as to substantially equalize the image printing density among the respective areas on the printing medium P. As a matter of fact, the ink coverage area and the printing density are not always in a proportional relationship. Therefore, it is necessary to conduct the HS processing tailored for the actual relationship therebetween. As a consequence of the HS processing, the numbers of formation of the dots are adjusted such that a total ink coverage area in the first area A1 is equal to a total ink coverage area in the second area A2 when the first and second areas A1 and A2 have the same printing duty. Thus, the apparent density is equalized between the first and second areas A1 and A2 owing to light absorption properties.

A variation in ink eject characteristic may also occur in a printing apparatus configured to use multivalued data that enables changes in dot size such as a printing apparatus configured to use quaternary data for printing an image by using dots in three tiers of large, medium, and small sizes, for example. Therefore, the present invention is not limited only to the printing apparatuses that use the binary data as explained in this embodiment, but is also applicable to printing apparatuses that use multivalued (tertiary or higher) data.

Figure 15:
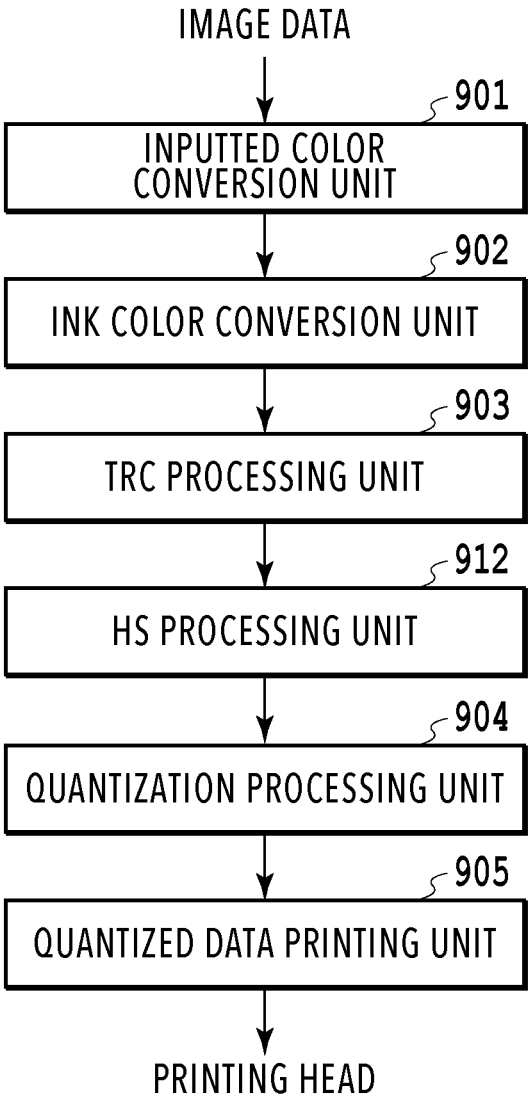
FIG. 15 is an explanatory diagram of image processing according to a second embodiment of the present invention.

FIG. 15 is an explanatory diagram of image processing inclusive of the HS processing.

In FIG. 15, the inputted color conversion unit 901, the ink color conversion unit 902, the TRC processing unit 903, the quantization processing unit 904, and the quantized data printing unit 905 are the same as those in the above-described embodiment shown in FIG. 7, and explanations thereof will be omitted. In terms of every printing area corresponding to a predetermined number of the ejection ports, an HS processing unit 912 converts the image data corresponding to the printing area based on a conversion table. Specifically, each piece of the image data of the each of ink color signals composed of 8 bits (256 values) processed by the TRC processing unit 903 is converted into the image data composed of each of the ink color signals corresponding to the ink eject characteristics (the eject amounts of the ink) of the printing head. In this embodiment, as with the TRC processing unit 903, the HS processing unit 912 uses a one-dimensional lookup table (LUT) in which input data are associated with output data.

Accordingly, it is possible to reduce the difference in printing density between the printing areas (corresponding to between the nozzles, between the heater boards, and between the printing heads, for example) attributed to the variation in eject amount of the ink from the nozzles corresponding to the ejection ports. Here, a conversion table corresponding to each of these categories of the printing areas is used in order to carry out the HS processing as appropriate.

In the meantime, an influence of the thickening of the pigment ink is unavoidable even when the above-described HS processing is involved. When the concentration of the pigment is changed due to the thickening of the pigment ink, change rates of an absolute amount of the pigment contained in each ejected ink droplet vary among the nozzles because of a variation in eject amount of the ink attributable to the manufacturing tolerances of the nozzles. Accordingly, change rates of the concentration also vary among the nozzles. As the thickening of the ink progresses, the rub fastness of the printed image is deteriorated to cause contamination of the inside of the printing apparatus. At the same time, unevenness in density of the image that has been once corrected by the HS processing may recur. For this reason, when the thickening of the ink progresses, the ink concentration information is estimated or detected as with the above-described first embodiment. Thus, the LUT to be used by the TRC processing unit 903 is switched based on the concentration information so as to reduce the number of eject of the ink. At the same time, by switching the LUT to be used by the HS processing unit 912, it is also possible to correct unevenness in printing density attributable to a difference in nozzle characteristic. The unevenness in printing density attributable to the difference in nozzle characteristic and to the ink concentration can be corrected when the LUT, which is designed to correct the unevenness in printing density attributable to the difference in nozzle characteristic and to increase the number of eject of the ink depending on the ink concentration, is used by the HS processing unit 912 on the basis of each nozzle. By selectively using the optimum LUT based on each nozzle (or based on each heater board, and the like) as described above, it is possible to correct the unevenness in printing density attributable to the difference in nozzle characteristic as with the case before the thickening of the ink. In addition to the number of eject of the ink in the unit area on the printing medium, the eject amount of the ink can also be changed by adjusting an amount of the ink in each droplet.

Other Embodiments

In the above-described embodiments, the cyan, magenta, yellow, and black inks are ejected from the different printing heads 105 to 108. However, the configuration of the printing head is not limited to the foregoing. For example, the cyan, magenta, yellow, and black inks may be ejected from one printing head. Alternatively, an ejection port row configured to eject the cyan, magenta, yellow, and black inks may be provided in the same heater board.

Meanwhile, the above-described embodiments have explained the full line type printing apparatus which uses the printing head longer than the width of the printing medium, and performs the printing by relatively moving the printing medium to the printing head in one direction. However, the configuration of the printing apparatus is not limited to the foregoing. For instance, the present invention is also applicable to a serial scan type printing apparatus. In the case of the serial scan type printing apparatus, an image is printed by repeating a printing operation to eject inks from a printing head while moving the printing head in a main scanning direction and a transporting operation to transport the printing medium in a sub scanning direction.

The present invention is also applicable to liquid eject apparatuses to perform various processing (such as printing, processing, coating, and the like) on various media by using liquid eject heads for ejecting liquids other than inks.

The present invention can also be realized by way of supplying a program for implementing one or more functions of any of the aforementioned embodiments to either a system or an apparatus through the intermediary of a network or a storage medium, and causing one or more processors in the system or a computer in the apparatus to read and execute the program. The present invention can also be realized in the form of a circuit (such as an ASIC) that implements one or more functions of any of the aforementioned embodiments.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-254136 filed Dec. 28, 2017, which is hereby incorporated by reference wherein in its entirety.

What is claimed is:

1. A printing apparatus comprising:

a printing head configured to eject an ink in a pressure chamber from ejection ports;

a movement unit configured to conduct relative movement between the printing head and a printing medium;

a circulation pathway configured to circulate the ink between the pressure chamber and outside;

a concentration acquisition unit configured to acquire concentration information concerning a concentration of the ink in the circulation pathway;

a data acquisition unit configured to acquire image data;

a generation unit configured to generate print data such that, in a case where the concentration information indicates a first concentration, print data indicating a first amount of ink is to be ejected for a pixel having a predetermined value in the acquired image data is generated, and in a case where the concentration information indicates a second concentration lower than the first concentration, print data indicating a second amount of ink larger than the first amount of ink is to be ejected for a pixel having the predetermined value in the acquired image data is generated; and a control unit configured to control the printing head in such a way as to eject the ink, from the ejection ports, based on the print data generated by the generation unit.

2. The printing apparatus according to claim 1, wherein the generation unit generates the print data based on the concentration information such that an amount of ink indicated by the print data generated for the pixel having the predetermined value in the acquired image data is larger as the concentration of the ink indicated by the concentration information is lower.

3. The printing apparatus according to claim 1, wherein the generation unit generates print data by using a a piece of correction data that is selected from a plurality of pieces of correction data based on the concentration information.

4. The printing apparatus according to claim 3, wherein the correction data is selected also based on a relationship between an amount of ink to be ejected for a pixel having the predetermined value and an optical density of an image to be printed on the printing medium by a predetermined number of ejections of the ink.

5. The printing apparatus according to claim 3, wherein the correction data table is selected switched depending on ejection characteristics of the ink at the ejection ports.

6. The printing apparatus according to claim 1, wherein the concentration information varies depending on a type of the ink.

7. The printing apparatus according to claim 1, wherein the concentration acquisition unit acquires the concentration information based on initial amount information concerning an initial amount of the ink in the circulation pathway, consumption amount information concerning a consumption amount of the ink in the circulation pathway, and evaporation amount information concerning an evaporation amount of the ink from the printing head.

8. The printing apparatus according to claim 7, wherein the consumption amount includes an amount of the ink ejected from the printing head during a printing operation and an amount of ink consumed during a recovery operation of the printing head.

9. The printing apparatus according to claim 7, wherein the evaporation amount includes an amount of the ink evaporating from the ejection ports of the printing head during the printing operation and an amount of the ink evaporating from the ejection ports of the printing head during a non-printing operation.

10. The printing apparatus according to claim 1, further comprising:

an ink tank configured to store the ink, wherein the circulation pathway circulates the ink between the pressure chamber and the ink tank.

11. A printing method of printing on a printing medium while conducting relative movement between the printing medium and a printing head configured to eject an ink in a pressure chamber from ejection ports, the printing method comprising:

a circulating step of circulating the ink through a circulation pathway provided between the pressure chamber and outside;

a concentration acquiring step of acquiring concentration information concerning a concentration of the ink in the circulation pathway;

a data acquisition step of acquiring image data;

a generation step of generating print data such that, in a case where the concentration information indicates a first concentration, print data indicating a first amount of ink is to be ejected for a pixel having a predetermined value in the acquired image data is generated, and in a case where the concentration information indicates a second concentration lower than the first concentration, print data indicating a second amount of ink larger than the first amount of ink is to be ejected for a pixel having the predetermined value in the acquired image data is generated; and a controlling step of controlling the printing head in such a way as to eject the ink, from the ejection ports, based on print data generated in the generation step.

12. A non-transitory computer-readable storage medium storing a program to be executed by a computer to implement a printing method of printing on a printing medium while conducting relative movement between the printing medium and a printing head configured to eject an ink in a pressure chamber from ejection ports, wherein the printing method includes:

a circulating step of circulating the ink through a circulation pathway provided between the pressure chamber and outside;

a concentration acquiring step of acquiring concentration information concerning a concentration of the ink in the circulation pathway;

a data acquisition step of acquiring image data;

a generation step of generating print data such that, in a case where the concentration information indicates a first concentration, print data indicating a first amount of ink is to be ejected for a pixel having a predetermined value in the acquired image data is generated, and in a case where the concentration information indicates a second concentration lower than the first concentration, print data indicating a second amount of ink larger than the first amount of ink is to be ejected for a pixel having the predetermined value in the acquired image data is generated; and a controlling step of controlling the printing head in such a way as to eject the ink, from the ejection ports, based on the print data generated in the generation step.

* * * * *